US007367622B2

(12) United States Patent
Roslund et al.

(10) Patent No.: US 7,367,622 B2
(45) Date of Patent: May 6, 2008

(54) TENSION ADJUSTMENT MECHANISM FOR A CHAIR

(75) Inventors: Richard N. Roslund, Jenison, MI (US); Matthew Rutman, Howell, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 11/598,167

(22) Filed: Nov. 10, 2006

(65) Prior Publication Data

US 2007/0057552 A1 Mar. 15, 2007

Related U.S. Application Data

(63) Continuation of application No. PCT/US2006/007818, filed on Mar. 1, 2006.

(60) Provisional application No. 60/657,524, filed on Mar. 1, 2005.

(51) Int. Cl.
*A47C 1/024* (2006.01)
*A47C 3/00* (2006.01)

(52) U.S. Cl. ..... 297/300.4; 297/302.4; 297/302.7; 297/303.4

(58) Field of Classification Search ..... 297/300.4, 297/300.5, 300.7, 300.8, 302.6, 302.7, 303.3, 297/303.4, 344.14, 344.13, DIG. 10
See application file for complete search history.

(56) References Cited

U.S. PATENT DOCUMENTS 2,056,965 A * 10/1936 Herold ..... 297/301.3
3,031,164 A 4/1962 Schopf
3,659,819 A 5/1972 Wolters
3,710,645 A 1/1973 Bennett
4,494,795 A 1/1985 Roossien et al.
4,603,905 A 8/1986 Stucki
4,669,330 A 6/1987 Stocker
4,796,950 A 1/1989 Mrotz, III et al.
4,805,479 A 2/1989 Brightwell
4,818,019 A 4/1989 Mrotz, III
4,854,185 A 8/1989 Lichtenberg et al.
4,865,384 A 9/1989 Desanta
4,911,501 A 3/1990 Decker et al.
5,046,780 A 9/1991 Decker et al.
5,106,157 A 4/1992 Nagelkirk et al.
5,121,934 A 6/1992 Decker et al.
5,224,758 A * 7/1993 Takamatsu et al. ..... 297/300.5

(Continued)

OTHER PUBLICATIONS

International Search Report mailed Oct. 11, 2006.
U.S. Appl. No. 11/449,556, Applicant: Matthew Rutman, filed Jun. 8, 2006 entitled Tension Adjustment Mechanism for a Chair.

*Primary Examiner*—Joe Edell
(74) *Attorney, Agent, or Firm*—Flynn, Thiel, Boutell & Tanis, P.C.

(57) ABSTRACT

A tilt control mechanism for an office chair includes a spring assembly therein which controls the tilt tension on the back assembly. This tilt control mechanism includes a tension adjustment assembly having a cam wedge which supports the legs of a pair of coil springs and a cooperating drive block assembly which cooperates with the cam wedge to drive the cam wedge upwardly and downwardly to vary the tilt tension. The drive assembly includes drive blocks mounted on a threaded shaft which are displaceable sidewardly toward and away from each other to either drive the cam wedge upwardly when the drive blocks move together or downwardly when the drive blocks move away from each other.

21 Claims, 22 Drawing Sheets

U.S. PATENT DOCUMENTS

| | | | | |
|---|---|---|---|---|
| 5,289,794 | A | 3/1994 | Jerro et al. | |
| 5,383,377 | A | 1/1995 | Boike | |
| 5,394,770 | A | 3/1995 | Boike et al. | |
| 5,435,202 | A | 7/1995 | Kitamura | |
| 5,477,745 | A | 12/1995 | Boike et al. | |
| 5,570,612 | A | 11/1996 | Reasoner | |
| 5,598,743 | A | 2/1997 | Yasuda | |
| 5,605,074 | A | 2/1997 | Hall et al. | |
| 5,655,415 | A | 8/1997 | Nagle et al. | |
| 5,673,596 | A | 10/1997 | Lu | |
| 5,709,132 | A | 1/1998 | Irish et al. | |
| 5,771,750 | A | 6/1998 | Bell et al. | |
| 5,788,328 | A | 8/1998 | Lance | |
| 5,823,063 | A | 10/1998 | Nagle et al. | |
| 5,909,924 | A | 6/1999 | Roslund, Jr. et al. | |
| 5,911,791 | A | 6/1999 | Srinivas | |
| 5,915,788 | A | 6/1999 | Schneider | |
| 5,921,143 | A | 7/1999 | Castillo et al. | |
| 5,934,150 | A | 8/1999 | Srinivas et al. | |
| 6,003,942 | A | 12/1999 | Haas | |
| 6,015,187 | A | 1/2000 | Roslund, Jr. et al. | |
| 6,216,555 | B1 | 4/2001 | Malone | |
| 6,247,380 | B1 | 6/2001 | Cebollero | |
| 6,263,756 | B1 | 7/2001 | Cebollero et al. | |
| 6,382,724 | B1 | 5/2002 | Piretti | |
| 6,435,056 | B2 | 8/2002 | Meyer | |
| 6,561,057 | B2 | 5/2003 | Cebollero | |
| 6,709,056 | B2 * | 3/2004 | Bock | 297/300.4 |
| 6,932,430 | B2 | 8/2005 | Bedford et al. | |
| 6,957,864 | B2 * | 10/2005 | Chen | 297/302.5 |
| 7,213,880 | B2 | 5/2007 | Schmitz et al. | |
| 7,213,886 | B2 | 5/2007 | Schmitz et al. | |
| 2001/0000939 | A1 | 5/2001 | Roslund, Jr. et al. | |
| 2002/0171277 | A1 | 11/2002 | Bock | |
| 2004/0183350 | A1 | 9/2004 | Schmitz et al. | |

* cited by examiner

TENSION ADJUSTMENT MECHANISM FOR A CHAIR

CROSS REFERENCE TO RELATED APPLICATION

This application is a continuation of PCT Application No. PCT/US06/07818, filed Mar. 1, 2006, which claims the benefit of U.S. Provisional Application No. 60/657,524, filed Mar. 1, 2005.

FIELD OF THE INVENTION

The invention relates to an office chair and more particularly, to improvements in the tilt control mechanism of the office chair.

BACKGROUND OF THE INVENTION

Conventional office chairs are designed to provide significant levels of comfort and adjustability. Such chairs typically include a base which supports a tilt control assembly to which a seat assembly and back assembly are movably interconnected. The tilt control mechanism includes a back upright which extends rearwardly and upwardly and supports the back assembly rearwardly adjacent to the seat assembly. The tilt control mechanism serves to interconnect the seat and back assemblies so that they may tilt rearwardly together in response to movements by the chair occupant and possibly to permit limited forward tilting of the seat and back. Further, such chairs typically permit the back to also move relative to the seat during such rearward tilting.

To control rearward tilting of the back assembly relative to the seat assembly, the tilt control mechanism interconnects these components and allows such rearward tilting of the back assembly. Conventional tilt control mechanisms include tension mechanisms such as spring assemblies which use coil springs or torsion bars to provide a resistance to pivoting movement of an upright relative to a fixed control body, i.e. tilt tension. The upright supports the back assembly and the resistance provided by the spring assembly thereby varies the load under which the back assembly will recline or tilt rearwardly. Such tilt control mechanisms typically include tension adjustment mechanisms to vary the spring load to accommodate different size occupants of the chair.

Additionally, conventional chairs also may include various mechanisms to control forward tilting of the chair and define a selected location at which rearward tilting is stopped.

Additionally, such chairs include a pneumatic cylinder which is enclosed within a base of the chair on which the tilt control mechanism is supported. As such, the pneumatic cylinder is selectively extendable to vary the elevation at which the tilt control mechanism is located to vary the seat height. Such pneumatic cylinders include conventional control valves on the upper ends thereof and it is known to provide pneumatic actuators which control the operation of the valve and thereby allow for controlled adjustment of the height of the seat.

It is an object of the invention to provide an improved tilt control mechanism for such an office chair.

In view of the foregoing, the invention relates to an office chair having an improved tilt control mechanism which controls rearward tilting of the back assembly relative to the seat assembly.

The tilt control mechanism of the invention incorporates a tension adjustment mechanism which cooperates with a pair of coil springs that defines the tilt resistance being applied to the chair uprights. A tension adjustment mechanism includes a cam wedge on the spring legs of the spring which cam wedge is movable upwardly and downwardly to vary the spring load being applied by the coil springs. This cam wedge has an arcuate surface that cooperates with a pair of drive blocks. These drive blocks are mounted on a common threaded shaft which extends laterally across the tilt control mechanism and are movable toward each other and away from each other. These drive blocks have curved surfaces which face upwardly in contact with the wedge. When the drive blocks are driven together, the wedge is driven upwardly to increase tilt tension, and when the drive blocks are moved apart from each other, the wedge moves downwardly to reduce the tilt tension. This mechanism provides an improved tension adjustment mechanism that is easier to actuate for the occupant.

Other objects and purposes of the invention, and variations thereof, will be apparent upon reading the following specification and inspecting the accompanying drawings.

Figure 2:
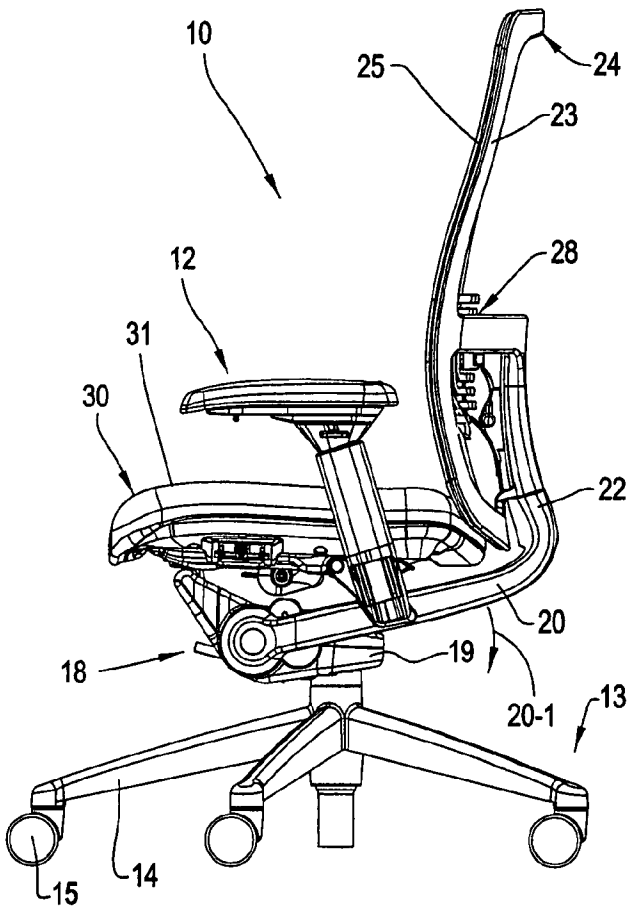
FIG. 2 is a side elevational view thereof.
Figure 1:
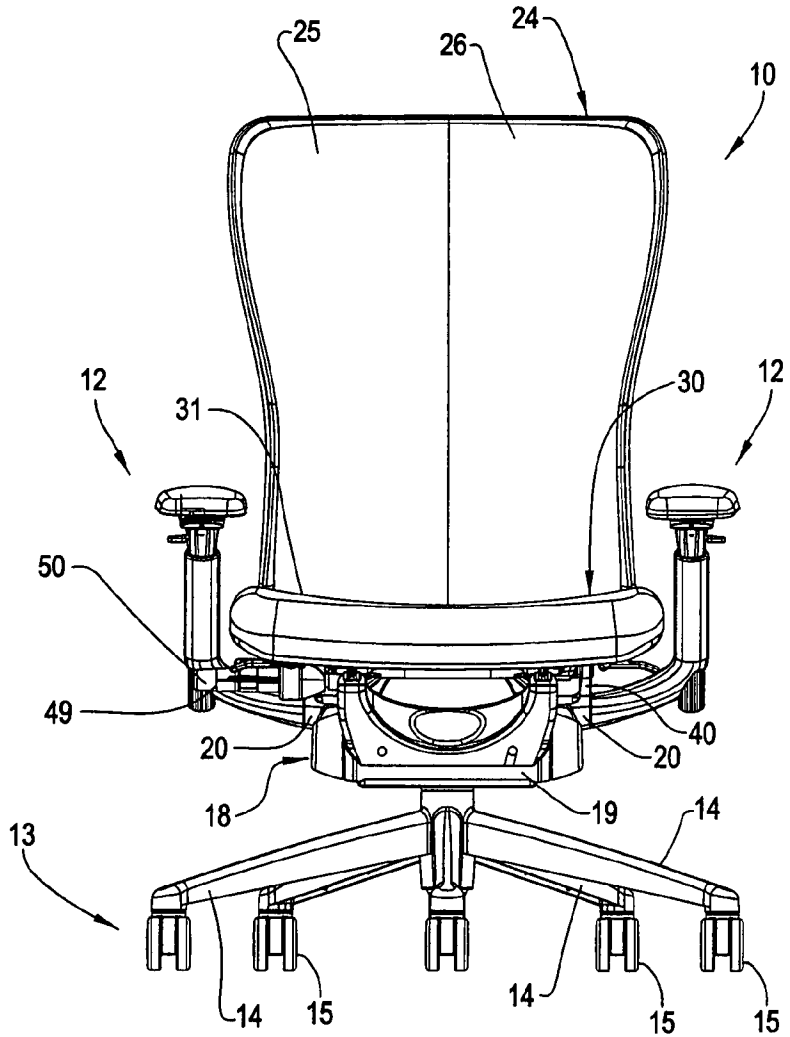
FIG. 1 is a front elevational view of an office chair of the invention.
Figure 4:
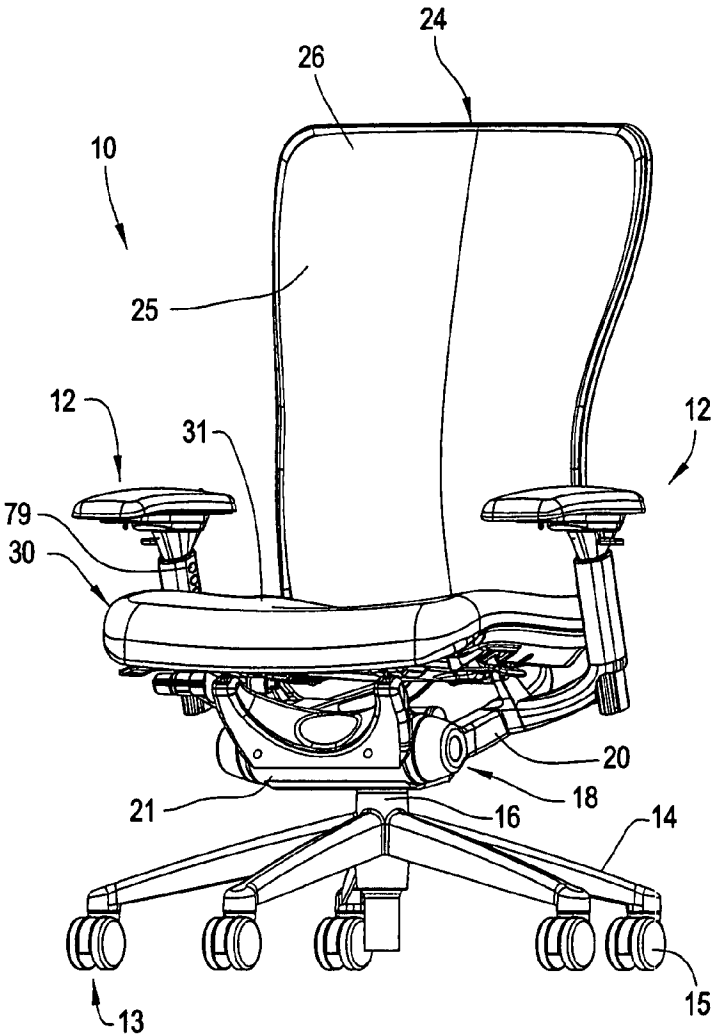
FIG. 4 is a front isometric view thereof.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIGS. 1-4, the invention generally relates to an office chair 10 which includes various inventive features therein which accommodate the different physical characteristics and comfort preferences of a chair occupant and also improve the assembly of the chair 10.

Generally, this chair 10 includes improved height-adjustable arm assemblies 12 which are readily adjustable. The structure of each arm assembly 12 is disclosed in U.S. Provisional Patent Application Ser. No. 60/657 632, filed Mar. 1, 2005, entitled ARM ASSEMBLY FOR A CHAIR, which is owned by Haworth, Inc., the common assignee of this present invention. The disclosure of this patent application is incorporated herein in its entirety by reference.

The chair 10 is supported on a base 13 having radiating legs 14 which are supported on the floor by casters 15. The base 13 further includes an upright pedestal 16 which projects vertically and supports a tilt control mechanism 18 on the upper end thereof. The pedestal 16 has a pneumatic cylinder therein which permits adjustment of the height or elevation of the tilt control mechanism 18 relative to a floor.

The tilt control mechanism 18 includes a control body 19 on which a pair of generally L-shaped uprights 20 are pivotally supported by their front ends. The uprights 20 converge rearwardly together to define a connector hub 22 on which is supported the back frame 23 of a back assembly 24. Additional stop and actuator features of the tilt control mechanism 18 are disclosed in U.S. Provisional Patent Application Nos. 60/657 541, filed Mar. 1, 2005, and 60/689 723, filed Jun. 10, 2005, both entitled TILT CONTROL MECHANISM FOR A CHAIR, which are owned by Haworth, Inc., the common assignee of the present invention. The disclosure of these patent applications are incorporated herein in their entirety by reference.

The back assembly has a suspension fabric 25 supported about its periphery on the corresponding periphery of the frame 23 to define a suspension surface 26 against which the back of a chair occupant is supported.

To provide additional support to the occupant, the back assembly 24 also includes a lumbar support assembly 28 which is configured to support the lumbar region of the occupant's back and is adjustable to improve the comfort of this support. The structure of this lumbar support assembly 28 and pelvic support structure is disclosed in U.S. Provisional Patent Application Ser. No. 60/657 312, filed Mar. 1, 2005, entitled CHAIR BACK WITH LUMBAR AND PELVIC SUPPORTS, which is owned by Haworth, Inc. The disclosure of this patent application is incorporated herein in its entirety by reference.

Additionally, the chair 10 includes a seat assembly 30 that defines an upward facing support surface 31 on which the seat of the occupant is supported.

Figure 5A:
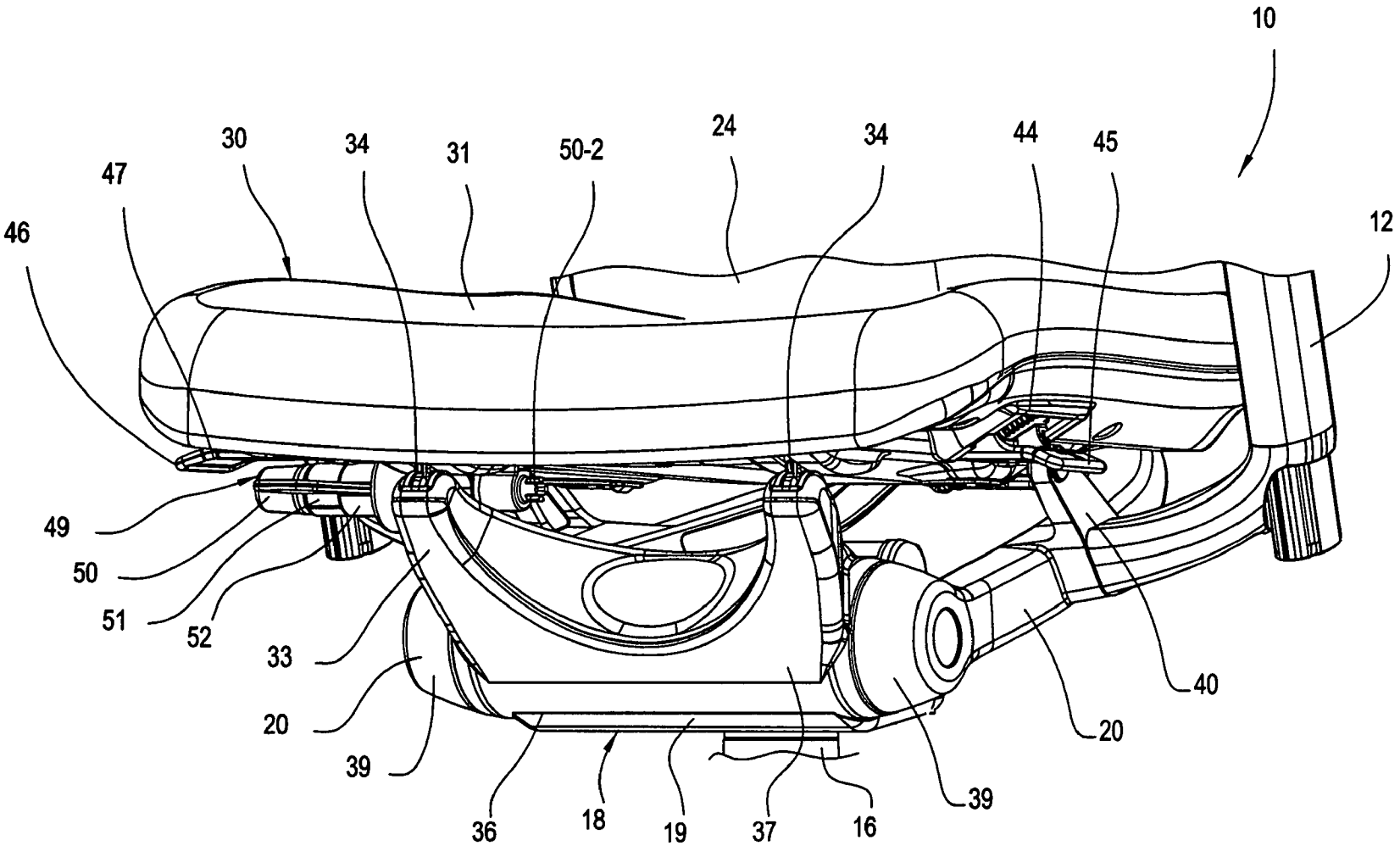
FIG. 5A is an enlarged side view of a tilt control mechanism and seat assembly of the chair.
Figure 5B:
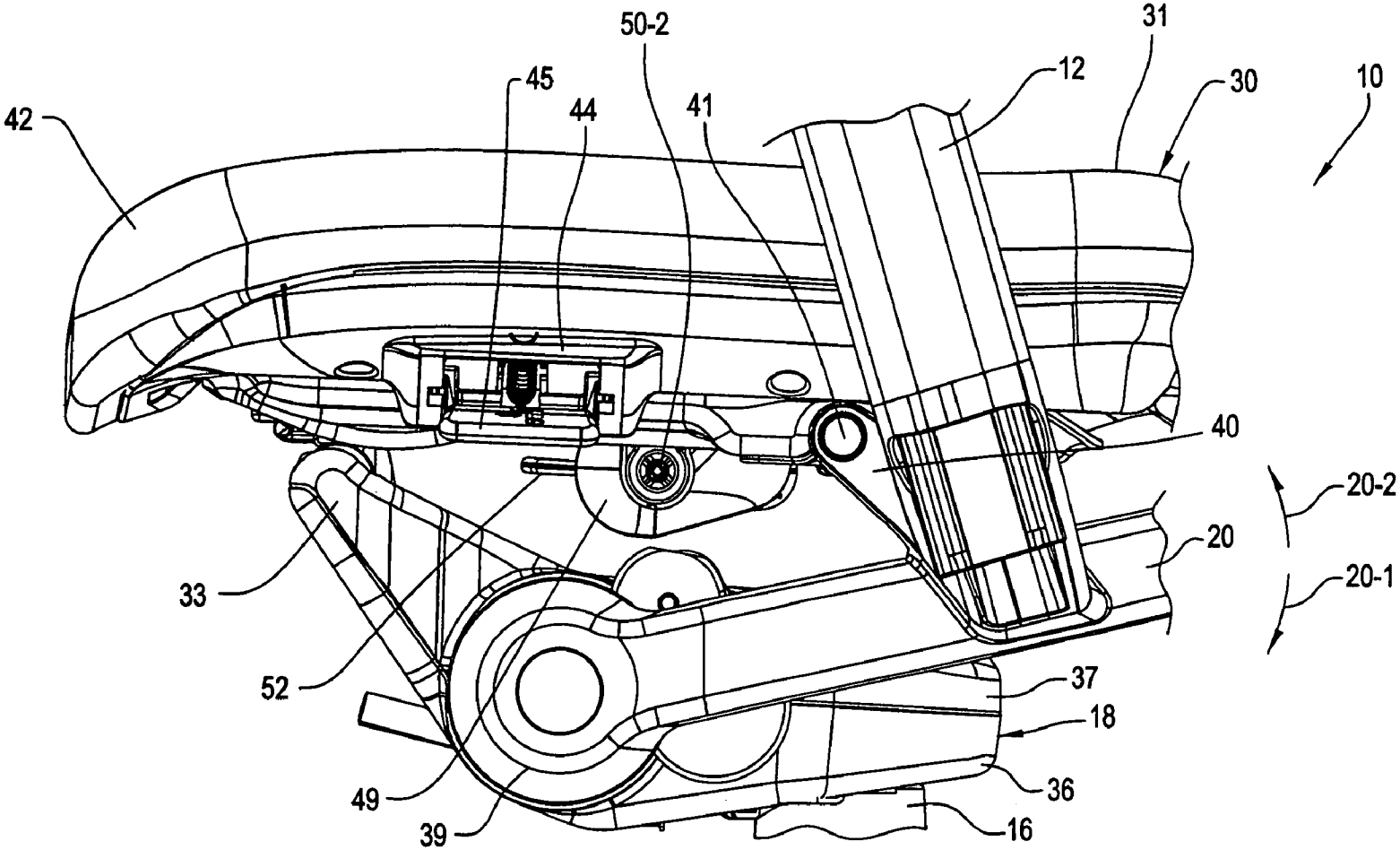
FIG. 5B is a front isometric view of the tilt control mechanism and seat assembly.

Referring to FIGS. 5A and 5B, the control body 19 is rigidly supported on the upper end of the pedestal 16 and extends forwardly therefrom to define a pair of cantilevered front support arms 33. Each upper end of the support arms 33 includes a seat retainer 34 which projects upwardly and slidably supports the front end of the seat assembly 30 on the upper ends of the support arms 33.

Figure 6A:
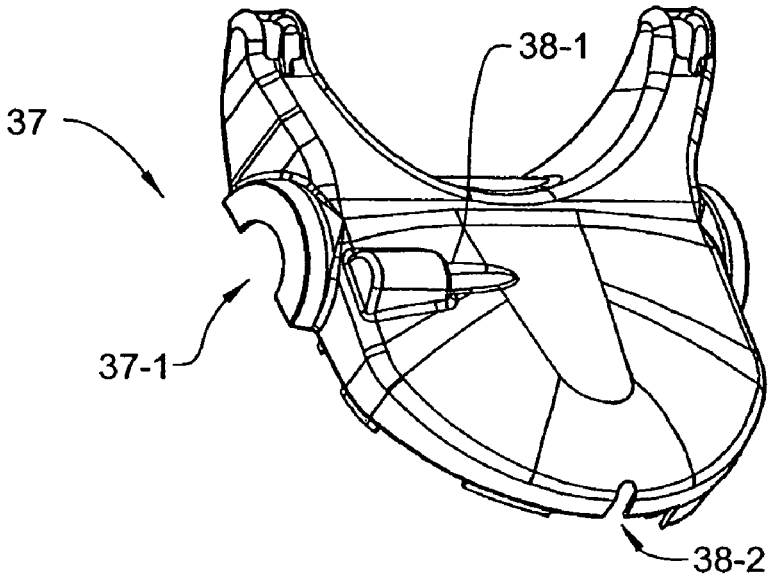
FIG. 6A is an isometric view of an upper cover.
Figure 6B:
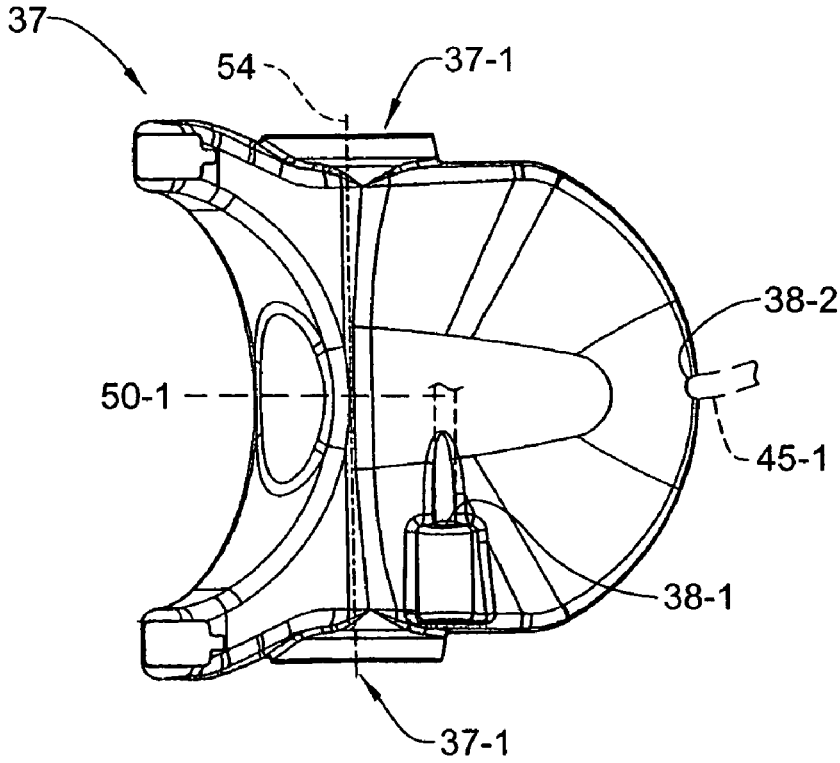
FIG. 6B is a plan view of the upper cover.

The tilt control mechanism 18 further includes a lower cover 36 and an upper cover 37 which are removably engaged with the remaining components of the tilt control mechanism 18. These covers 36 and 37 define the exposed surfaces of the tilt control mechanism 18 and hide the interior components. As seen in FIGS. 6A and 6B, the upper cover 37 includes side openings 37-1 which align with a rotation axis 69 and receive a hex shaft 53 therethrough. The upper cover 37 also includes a bore 38-1 and a cable slot 38-2 in the rear edge thereof.

Figure 3:
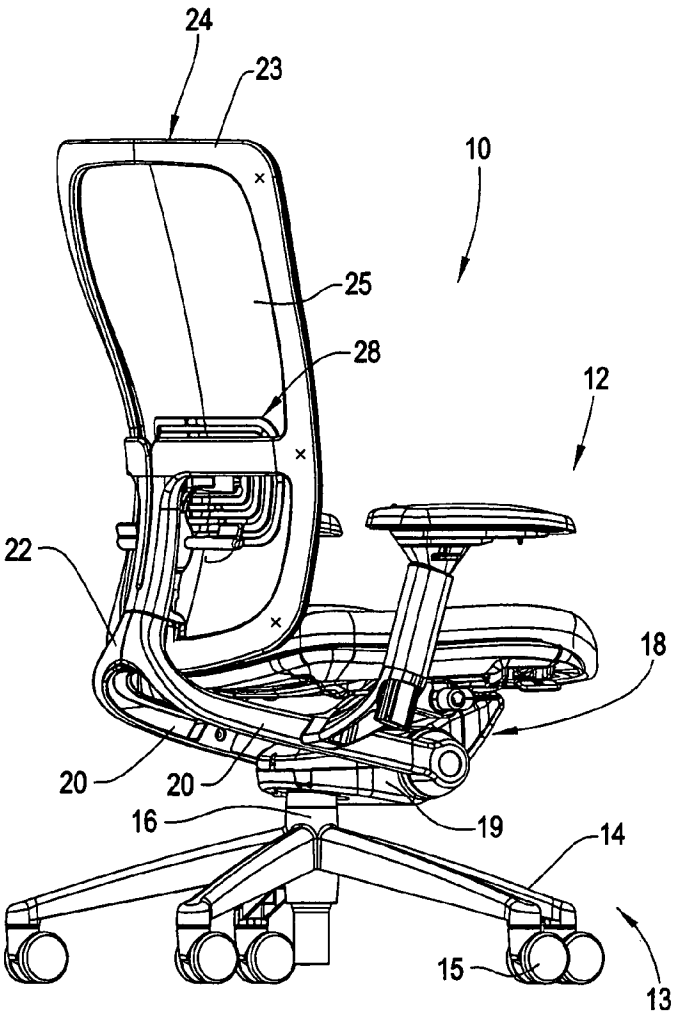
FIG. 3 is a rear isometric view thereof.

Further as to FIGS. 5A and 5B, the uprights 20 are pivotally connected at their front ends 39 to the sides of the tilt control mechanism 19 so as to pivot downwardly in unison. The middle portion of these uprights 20 includes the arm assemblies 12 rigidly affixed thereto, as also illustrated in FIGS. 2 and 3, wherein these uprights 20 define the support hub 22 for supporting the back assembly 24 thereon. As indicated by reference arrow 20-1 in FIG. 5B, the uprights 20 are adapted to pivot clockwise in a downward direction during reclining of the back assembly 24 and also may pivot upwardly (reference arrow 20-2) to a limited extent in the counter clockwise direction to permit forward tilting of the seat assembly 30.

Each upright 20 also includes a seat mount 40 which projects upwardly towards the seat assembly 30 and includes a support shaft 41 that supports the back end of the seat assembly 30. As such, downward pivoting of the uprights 20 causes the back of the seat assembly 30 to be lowered while forward tilting of the chair causes the back of the seat assembly 30 to lift upwardly while the front seat edge 42 pivots about the seat retainers 34 generally in a downward direction. As such, the combination of the tilt control mechanism 18, uprights 20 and seat assembly 30 effectively define a linkage that controls movement of the seat assembly 30 and also effects rearward tilting of the back assembly 24.

In addition to the foregoing, the chair 10 (FIGS. 5A and 5B) further includes various actuators that allow for adjustment of the various components of the seat assembly 30 and tilt control mechanism 18. More particularly, the seat assembly first mounts a lever assembly 44 that has a pivoting lever 45 connected thereto. This pivot lever 45 is connected to an actuator cable 45-1 (FIG. 6B) and serves to control activation of the pneumatic cylinder to permit adjustment of the height of the seat assembly 30 when the lever 45 is lifted.

On the opposite side of the seat assembly, an additional lever assembly 46 is provided which includes a pivotable lever 47. This lever assembly 46 is connected to a sliding seat mechanism in the seat assembly 30 to permit sliding of the seat 30 in a front to rear direction and then lock out sliding when the lever 47 is released.

Also, the chair 10 includes a multi-function handle assembly 49 (FIG. 5A). The outer end of this handle assembly 49 includes a tension adjustment crank 50 which connects to a flexible adjustment shaft 50-1 (FIG. 6B) at crank connector 50-2 (FIG. 5A). The adjustment shaft 50-1 cooperates with the tilt control mechanism 19 to adjust the tilt tension generated thereby during rotation of shaft 50-1 by crank 50 as will be discussed in further detail hereinafter.

Also, the handle assembly 49 includes flipper levers 51 and 52 which are each independently movable and may be rotated separate from each other to vary the rear stop and front stop locations defined by the tilt control mechanism 19. The function of this handle assembly 49 will be discussed in further detail hereinafter.

Figure 7:
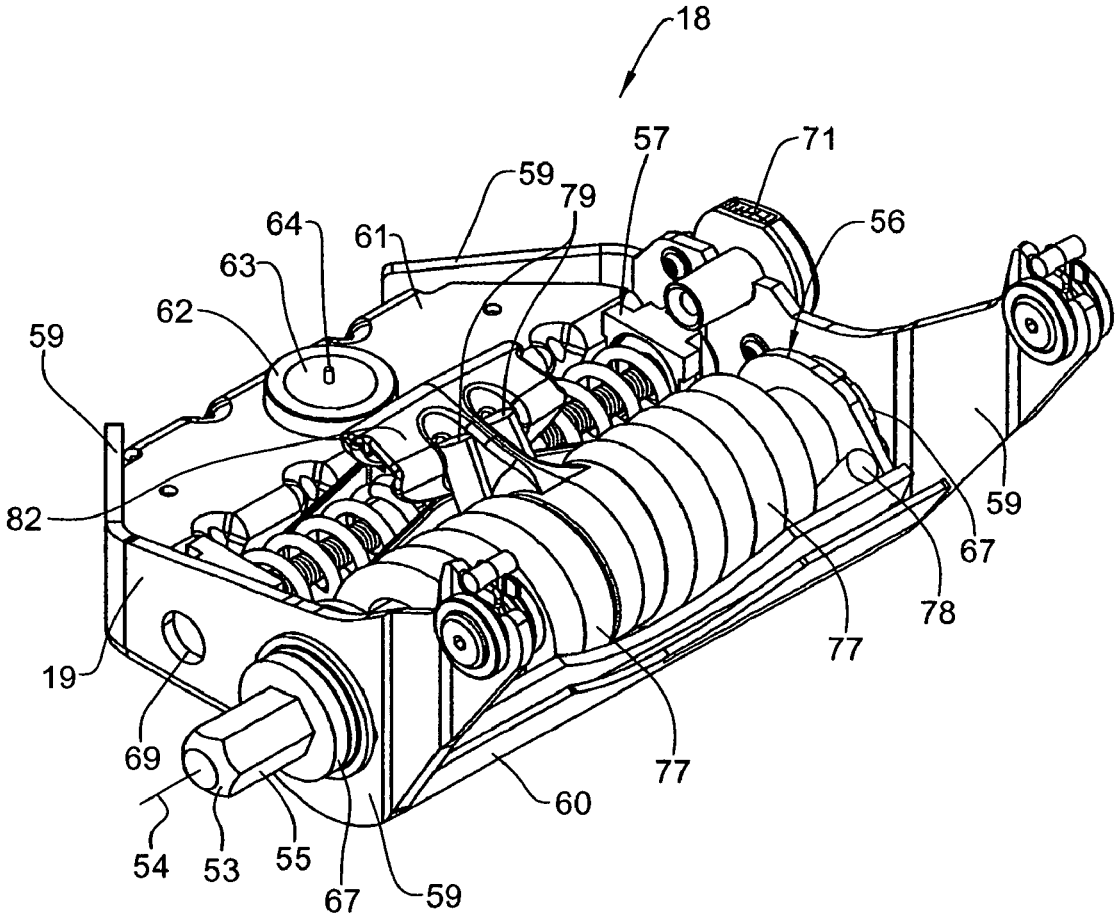
FIG. 7 is a front isometric view of the tilt control mechanism removed from the chair.
Figure 8:
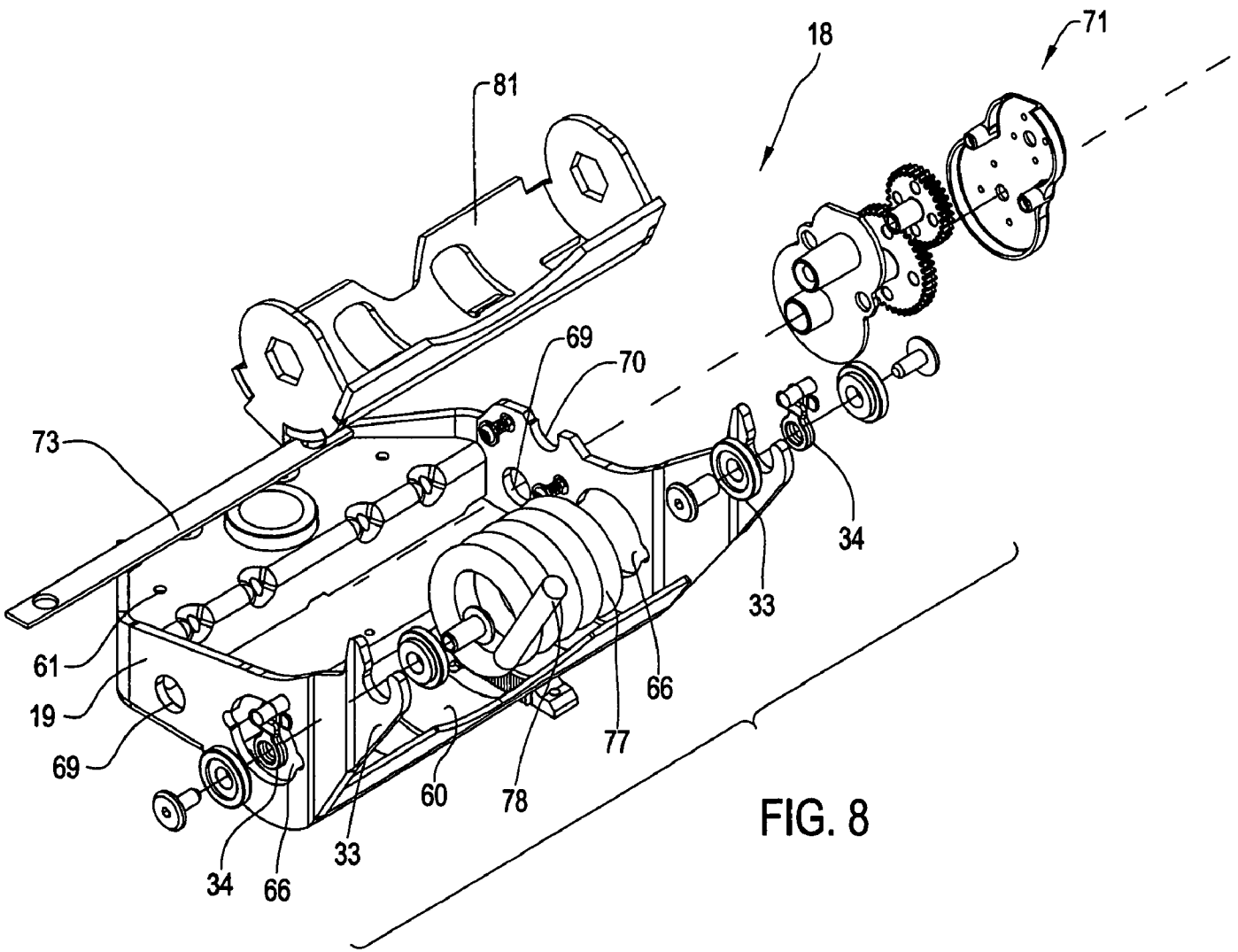
FIG. 8 is an exploded isometric view of the tilt control mechanism.
Figure 9:
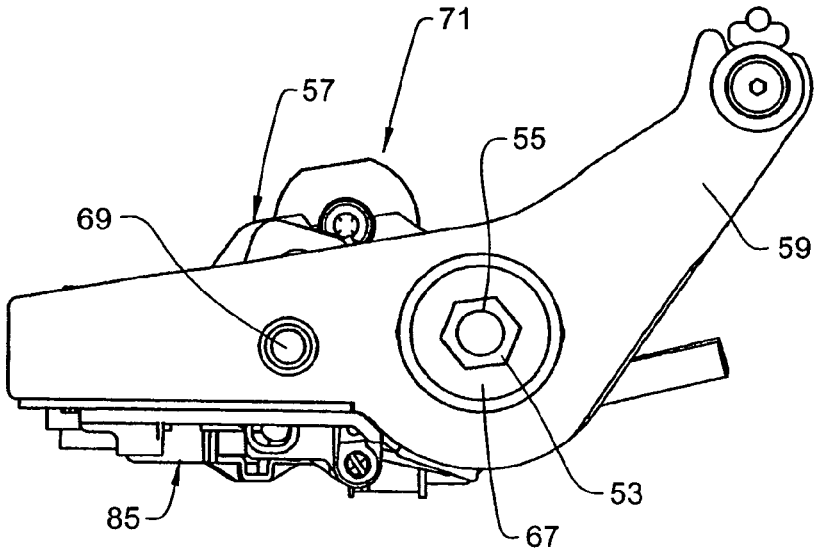
FIG. 9 is a side view thereof.
Figure 10:
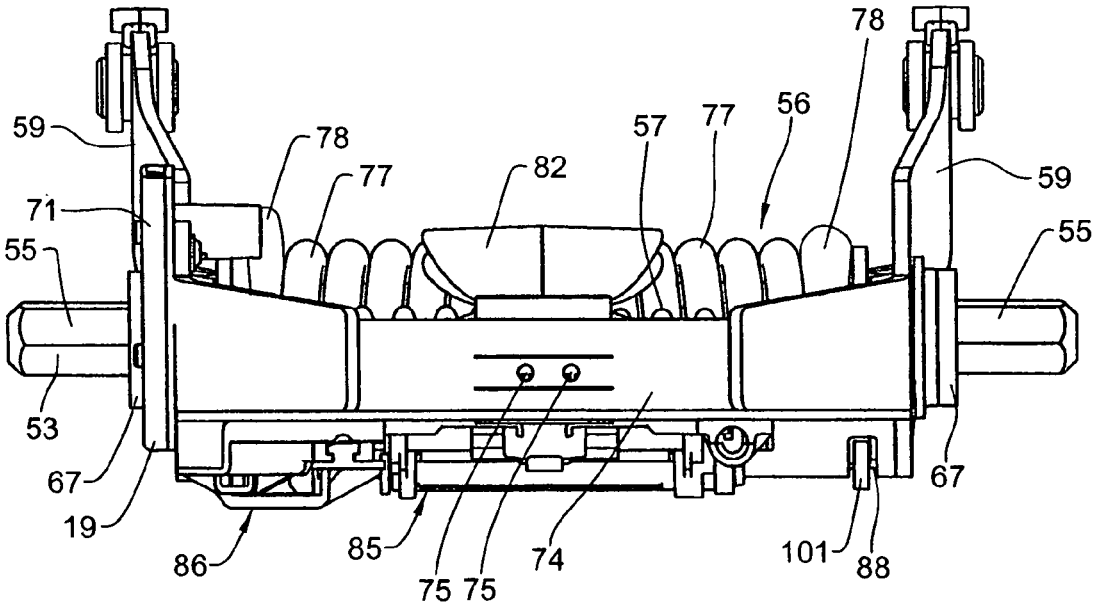
FIG. 10 is a rear view thereof.

Referring to FIGS. 7 and 8, the tilt control mechanism 18 is illustrated with the lower and upper covers 36 and 37 removed therefrom. The tilt control mechanism 18 includes the control body 19 which pivotally supports a hex shaft 53 on which are supported the uprights 20. The uprights 20 connect to the exposed shaft ends 55 and pivot in unison with the hex shaft 53 about a horizontal tilt axis 54 wherein a spring assembly 56 (FIG. 57)is provided to apply tilt tension to the hex shaft 53 which resists rotation of the shaft 53 while still permitting pivoting of the shaft 20 about the tilt axis 54 during tilting of the back assembly 24. To adjust this tilt tension, the spring assembly 56 cooperates with an adjustment assembly 57 that varies the spring load generated by the spring assembly 56 and varies this tilt tension.

Referring more particularly to FIGS. 7-11, the control body 19 is formed as a weldment of steel plates which comprise a pair of side walls 59 that are supported on the control body bottom wall 60. The front ends of the side walls 59 extend upwardly to define the support arms 33, in which the seat retainers 34 are mounted.

The back end of the control body 19 includes a brace section 61 which includes a cylindrical cylinder mount or plug 62 in which is received the upper end of a pneumatic cylinder 63. The upper end of the pneumatic cylinder 63 includes a conventional cylinder valve 64 (FIGS. 7 and 11) projecting upwardly therefrom. This cylinder mount 62 is rigidly connected to the upper end of the pedestal 16 so that the tilt control mechanism 18 is rigidly connected to the base 13.

To support the hex shaft 53 and spring assembly 56, the side walls of the control body 19 include a pair of shaft openings 66 (FIG. 8). The shaft openings 66 include a bushing assembly 67 for rotatably supporting the hex shaft 53 therein. Additionally, the side walls 59 each include a further shaft opening 69 to support each end of the adjustment assembly 57 as will be described in further detail hereinafter. Also, a notch 70 is provided just above one of these openings 69 for supporting an upper end of a gear box 71.

Figure 12:
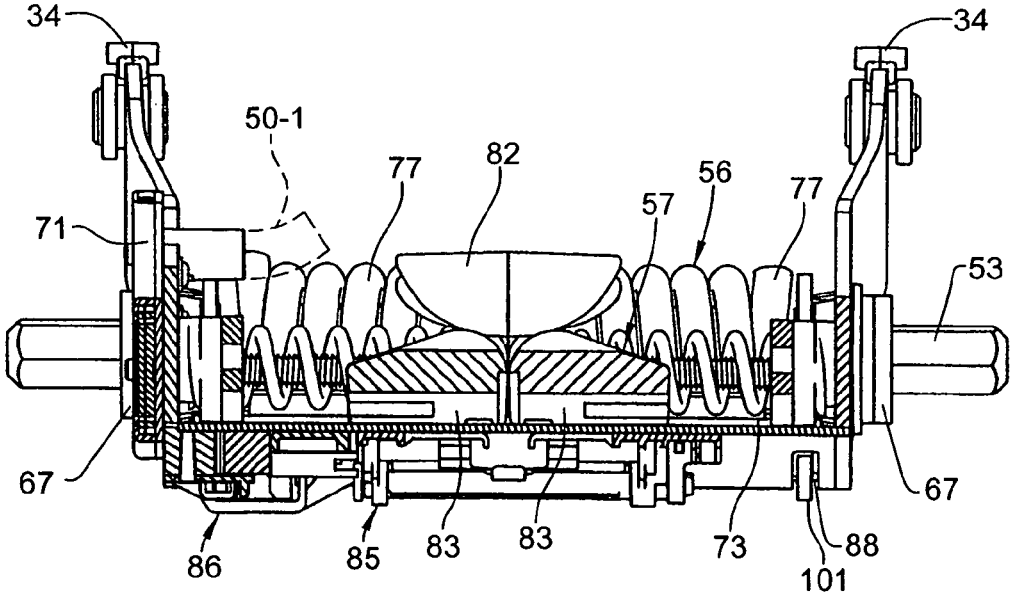
FIG. 12 is a rear cross sectional view thereof.

In the bottom of the control body 19, a rectangular guide rail 73 is mounted therein (FIGS. 8 and 12). Further, the back body wall 74 (FIG. 10) includes a pair of fastener bores 75 to support a mechanism for controlling the pneumatic cylinder valve 64.

More particularly as to the spring assembly 56, this assembly 56 comprises the hex shaft 53 and further includes a pair of coil springs 77 which each include front spring legs 78 and rear spring legs 79. Still further, a control plate or limit bracket 81 is also mounted on the hex shaft 53 so as to rotate therewith. The front spring legs 78 bear against this control plate 81 such that rotation of the hex shaft 53 causes the limit bracket 81 to pivot and deflect the front spring legs 78 relative to the rear spring legs 79. This relative deflection between the spring legs 77 and 78 therefore generates a tilt tension on the hex shaft 53 which resists rearward tilting of the uprights 20 in direction 20-1 (FIG. 5B).

Generally, the adjustment assembly 57 acts upon the rear spring legs 79 to deflect the rear spring legs 79 relative to the front spring legs 78 and vary the initial tilt tension which also varies the overall tilt tension generated during rearward tilting of the uprights 20. The adjustment assembly 57 is connected to the gear box 71 which gear box 71 is driven by the adjustment crank 50 referenced above through the associated shaft 50-1 (FIGS. 6B and 12).

Generally, the adjustment assembly 57 includes a cam wedge 82 (FIG. 12) which has the rear spring legs 79 pressing downwardly thereon. The cam wedge 82 therefore is pressed downwardly against a pair of drive blocks 83 which may be selectively moved inwardly toward each other or outwardly away from each other in response to rotation of the shaft 50-1 to effect raising and lowering of the wedge 82 and adjustment of the tilt tension.

Figure 13:
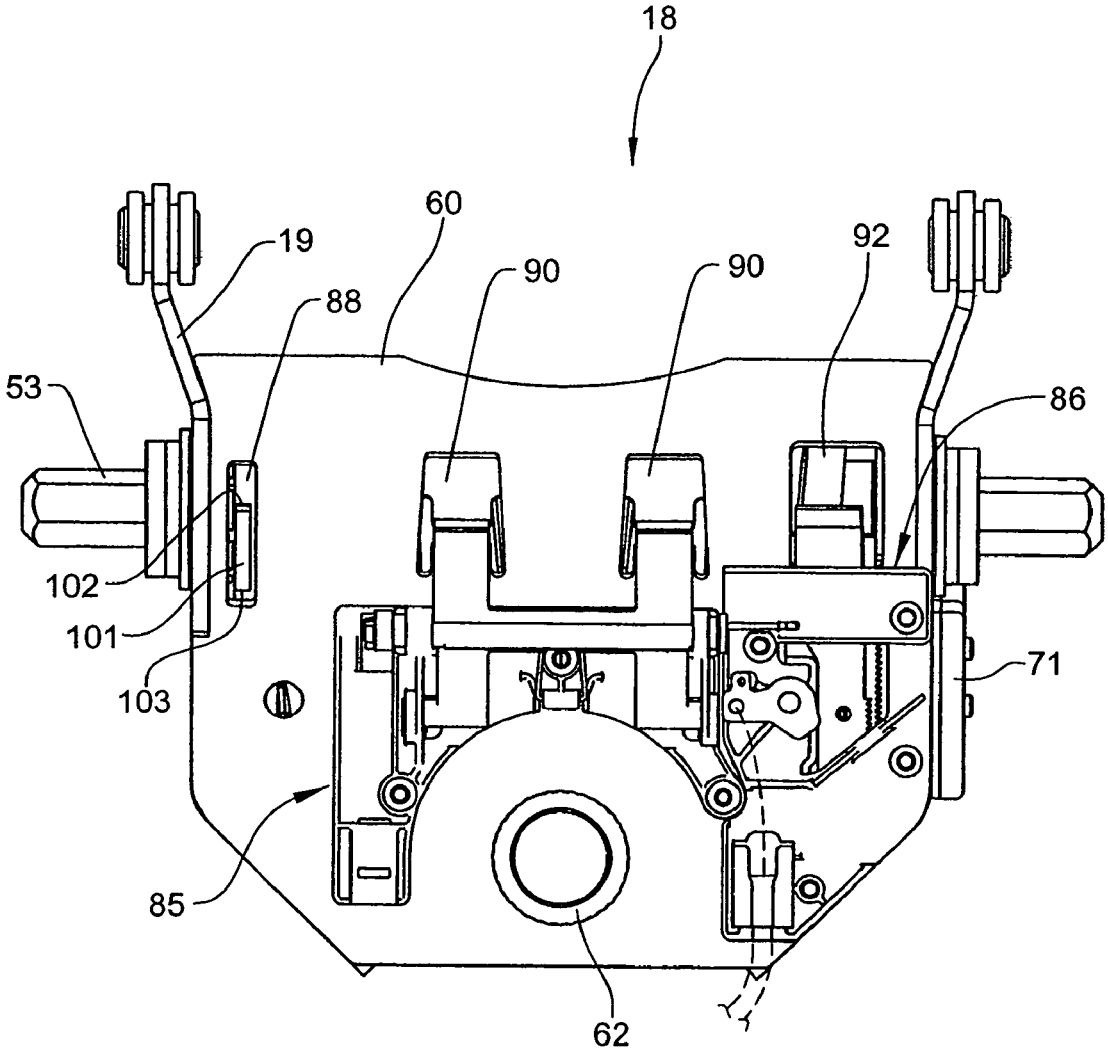
FIG. 13 is a bottom view thereof.
Figure 14:
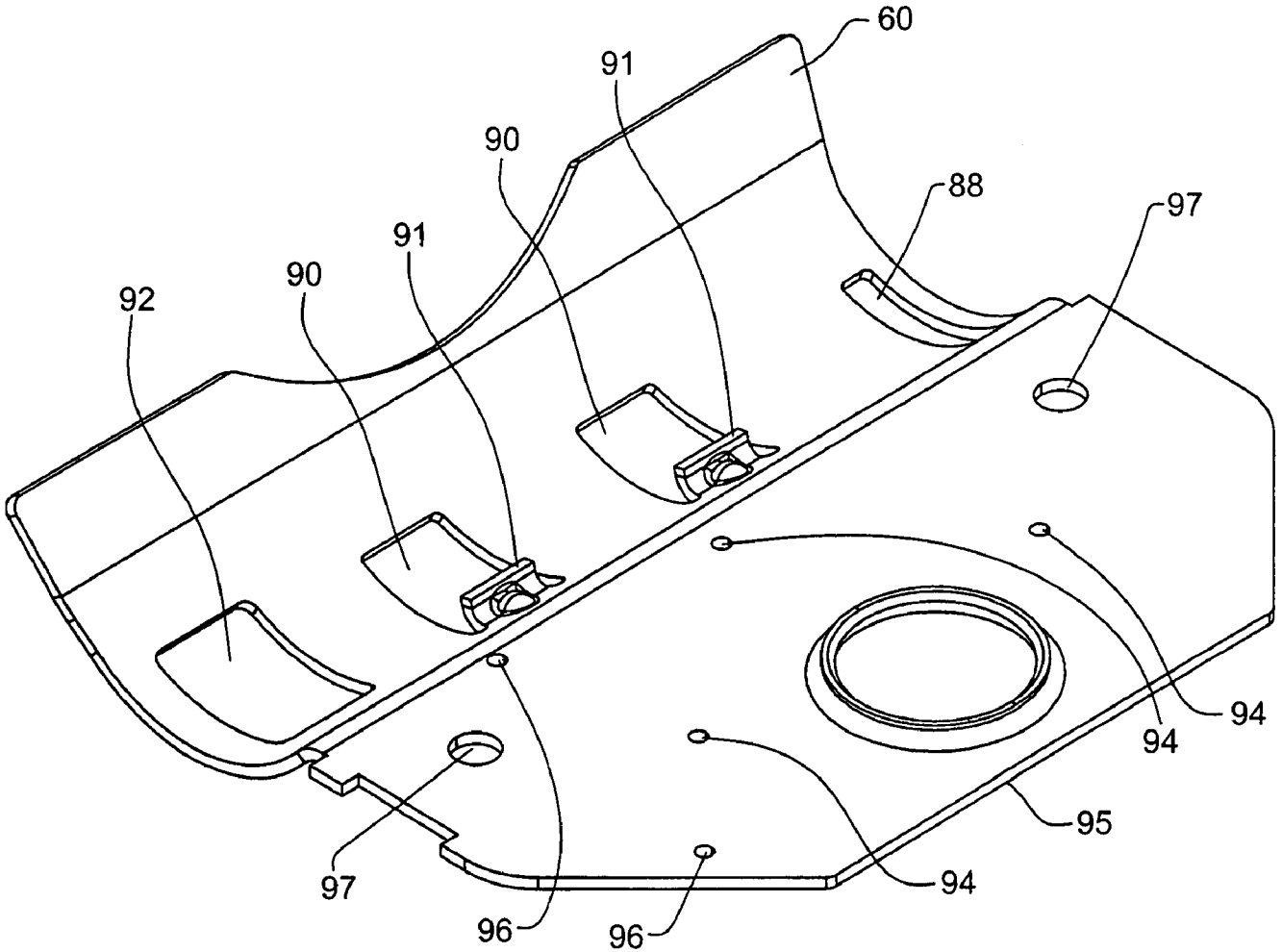
FIG. 14 is an isometric view of a bottom housing plate of the control body.

With the above-described arrangement, the tilt tension being applied to the hex shaft 53 may be readily adjusted by the adjustment crank 50. In addition to this adjustment mechanism 57, the tilt control mechanism 19 also provides for additional mechanisms which serve as front and rear stops that can selectively lock out and control forward tilting and rearward tilting of the uprights 20. Referring to FIG. 13, the bottom of the tilt control mechanism 18 may include a front stop assembly 85 and a rear stop assembly 86 which mount to the bottom of the bottom body wall 60. These stop assemblies 85 and 86 generally cooperate with the limit bracket 81 referenced above that rotates in combination with the hex shaft 53. In this regard, the bottom body wall 60 (FIG. 14) is provided with a plurality of stop openings therein. In particular, a narrow slot 88 is provided which governs the rearmost limit of tilting of the uprights 20 as will be described in further detail. Additionally, a pair of front stop windows 90 are provided in the center portion of the bottom plate 60 and are generally rectangular except that they include upstanding flanges 91 along the rear edge thereof. Lastly, the bottom plate 60 also includes a rear stop window 92.

Figure 18:
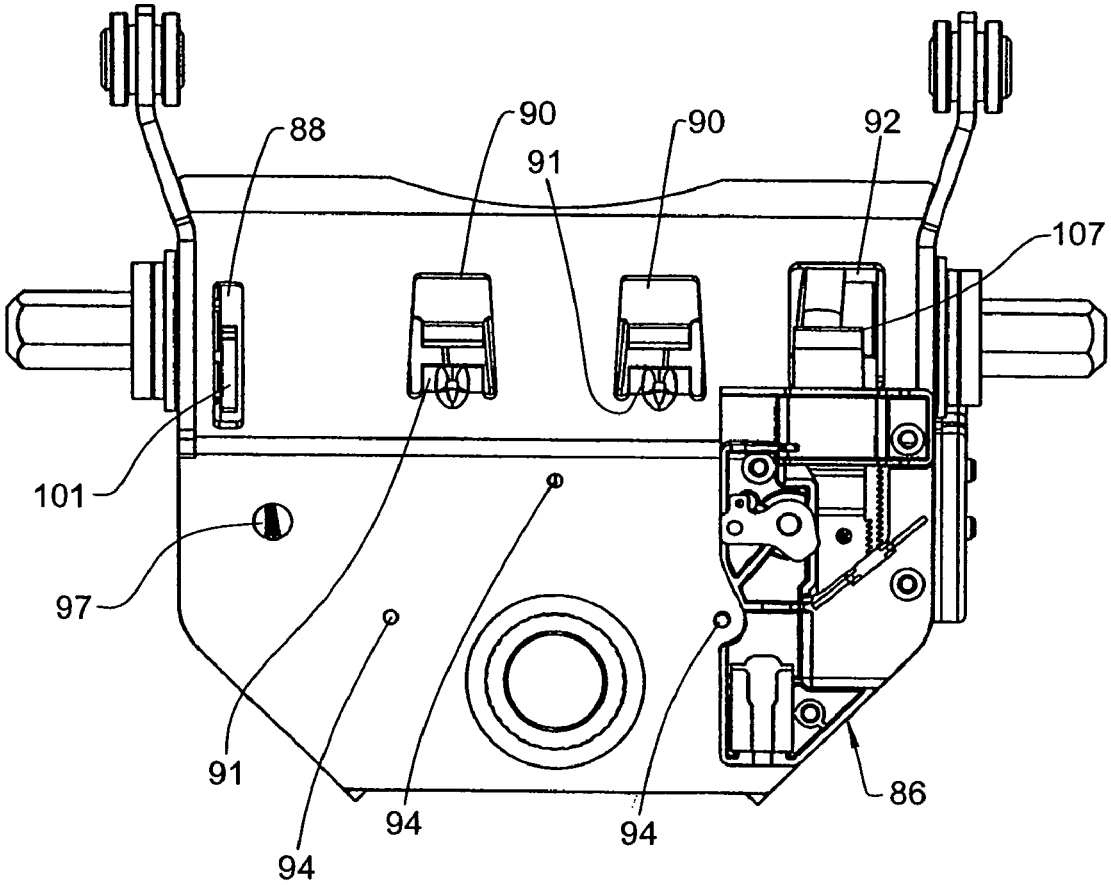
FIG. 18 is a bottom view of the tilt control mechanism with a front stop assembly removed therefrom.
Figure 19:
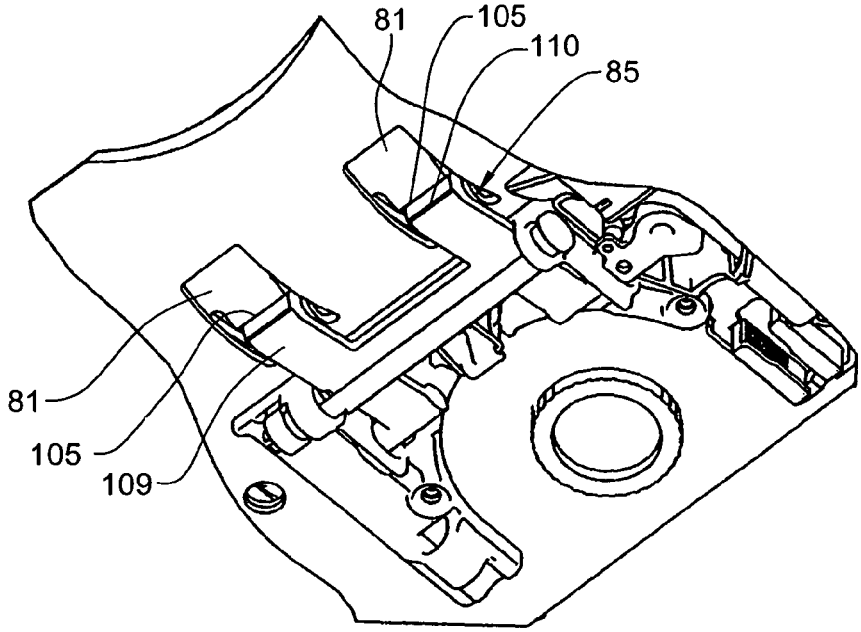
FIG. 19 is a bottom isometric view of the front stop mechanism.

The bottom wall 60 is adapted to secure the front stop assembly 85 and rear stop assembly 86 thereto. Therefore, three fastener bores 94 (FIGS. 14 and 18) are provided for securing the front stop assembly 85 to the bottom wall surface 95. Two additional fastener bores 96 (FIG. 14) are provided to fasten the rear stop assembly 86 also to the bottom wall surface 95. Two additional bores 97 are provided to secure the guide rail 73 to this bottom wall 60.

Figure 17:
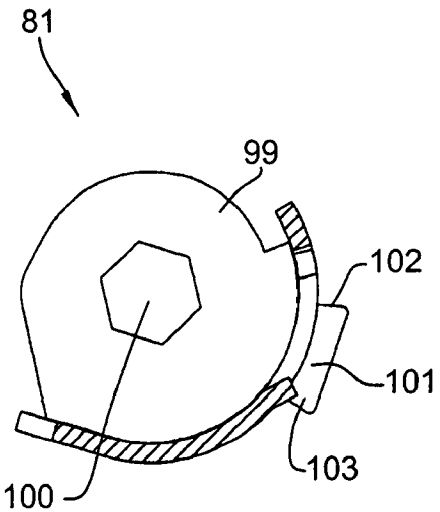
FIG. 17 is a side cross sectional view of the control plate as taken along line 17-17 of FIG. 15.
Figure 16:
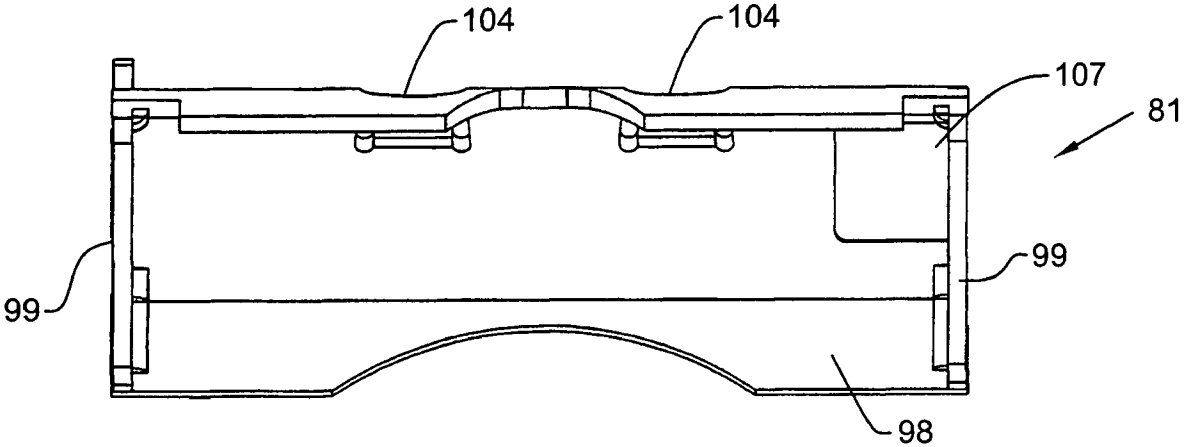
FIG. 16 is a rear view of the control plate.
Figure 15:
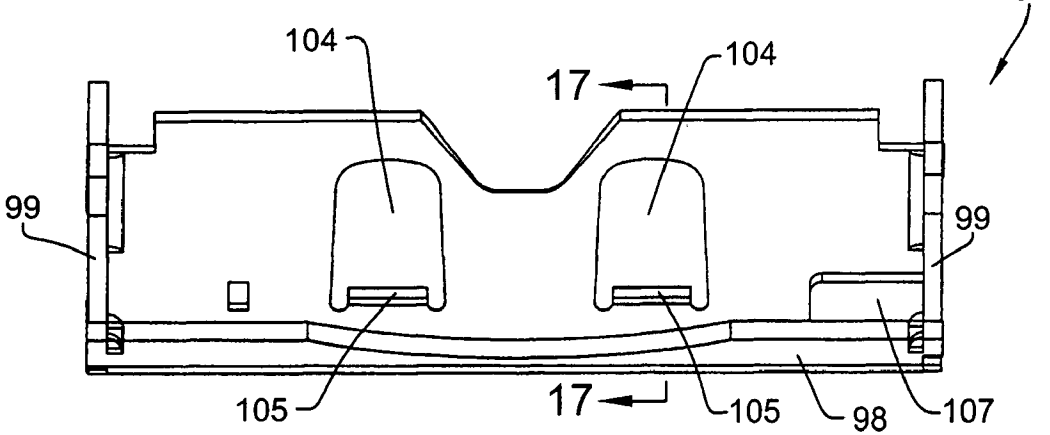
FIG. 15 is a plan view of the control plate.

As generally seen in FIG. 13, the front stop openings 90 align with the front stop mechanism 85 while the rear stop opening 92 aligns with the rear stop mechanism 86. More particularly, these stop mechanisms 85 and 86 communicate through these windows 90 and 92 to engage the limit bracket 81 which rotates over these openings during pivoting of the hex shaft 53. More particularly, the limit bracket 81 is illustrated in FIGS. 15-17 as having a semi-circular main wall 98 which is enclosed at its opposite ends by side walls 99. Each side wall 99 includes a hex shaft opening 100 through which the hex shaft 53 is non-rotatably received. This hexagonal shaft opening 100 conforms to the shape of the hex shaft 53 such that this limit bracket 81 pivots in unison therewith.

To define one end of the total range of motion for the uprights 90, one of these side walls 99 includes a stop flange 101 projecting radially therefrom that has opposite ends 102 and 103 which are circumferentially spaced apart. This limit flange 101 projects through the corresponding slot 88 formed in the bottom body wall 60 as seen in FIG. 13. The first flange end 102 is adapted to abut against the front edge of the slot 88 during rearward tilting to define the farthest-most limit of rearward tilting.

In addition to the limit flange 101, the limit bracket 81 is formed with a pair of front stop openings 104 which include edge flanges 105 that rigidify this edge so that it may abut against the front stop mechanism 85 and will undergo increased loads as a result thereof. The front plate wall 98 further includes a rear stop opening 107 that aligns with the rear stop window 92 in the bottom body wall 60. This rear stop opening 107 cooperates with the rear stop mechanism 86 such that the user may define any desired rear stop position for the chair.

Figure 20:
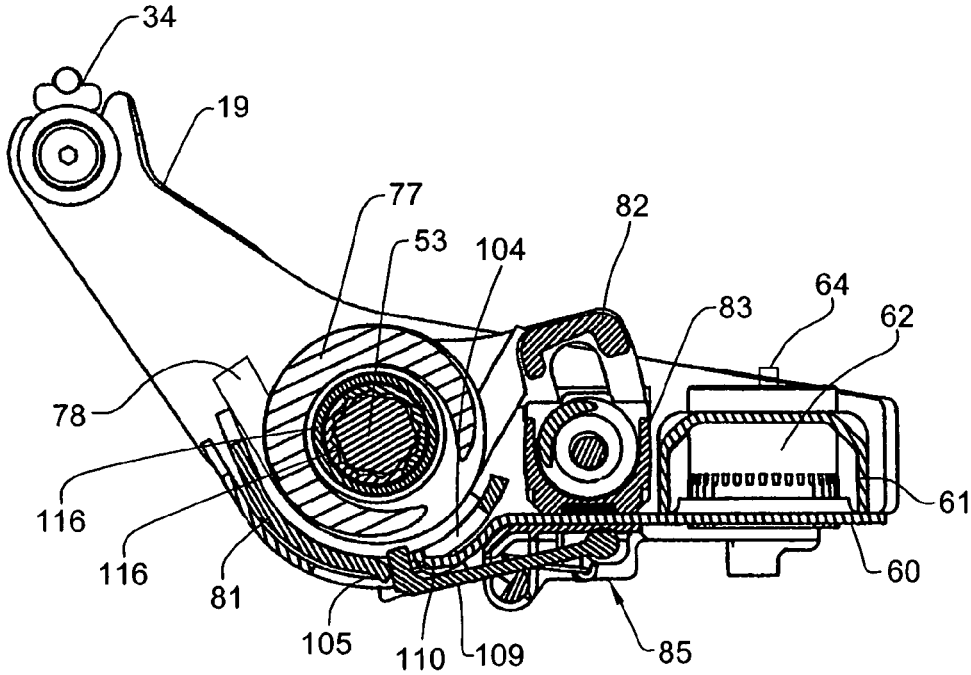
FIG. 20 is a side cross sectional view of the tilt control mechanism as taken through the front stop assembly.

Generally as to the front stop assembly 85, this assembly 85 includes a pivoting stop lever 109 which has an upwardly projecting stop finger 110 which inserts through the front stop window 90 in the housing body 60 and upwardly into the aligned front stop opening 104 in the control plate 81. This stop finger 110 is adapted to contact and abut against the corresponding edge flange 105 of the front stop opening 104 so as to prevent forward tilting of the uprights 20 past this position as seen in FIG. 20. However, this front stop opening 104 is circumferentially elongate (FIG. 20) and thus, still permits rearward tilting of the uprights 20. The rear stop assembly 86 generally operates similar to the front stop assembly 85.

Figure 21:
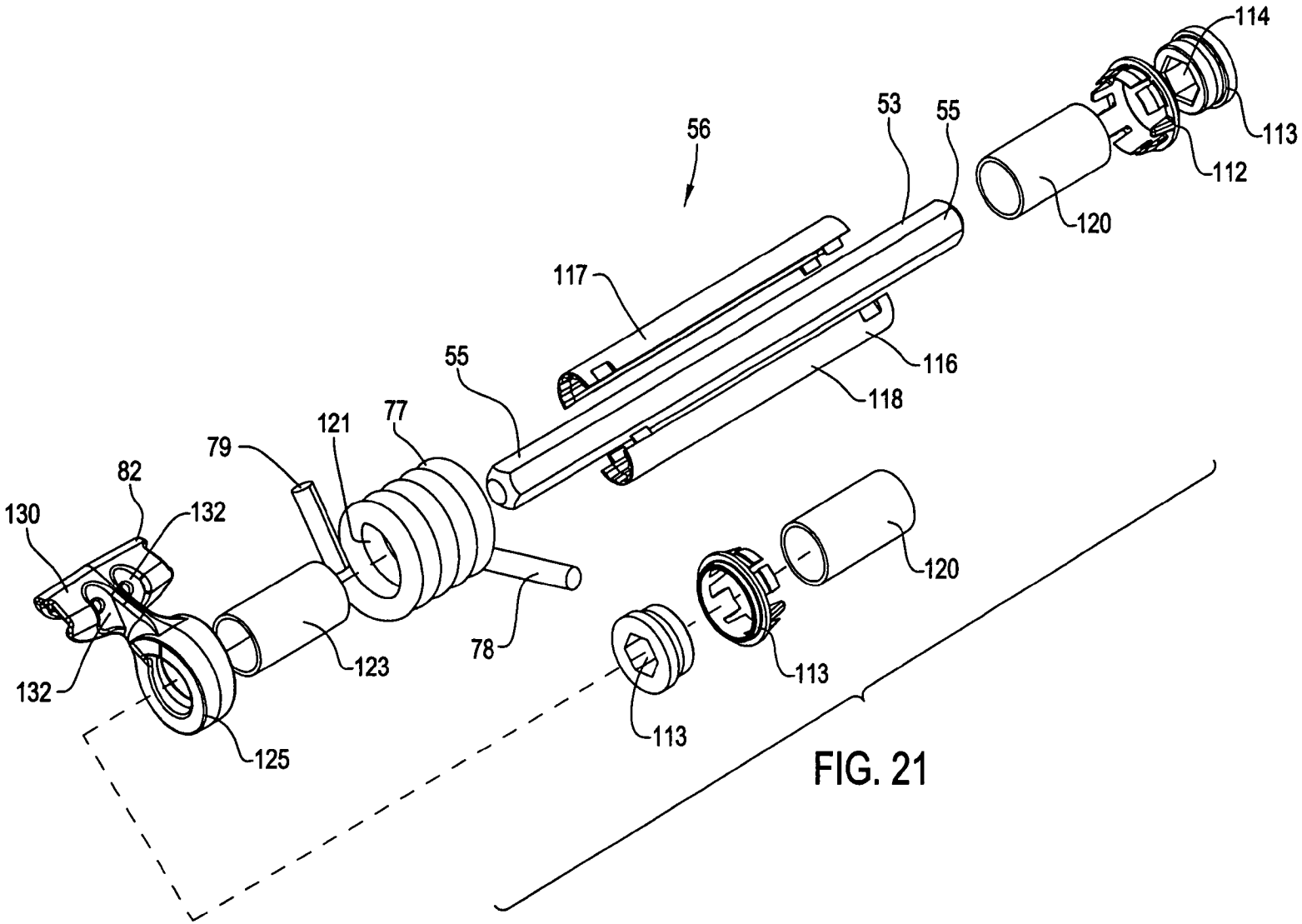
FIG. 21 is an exploded view of the spring assembly.
Figure 22:
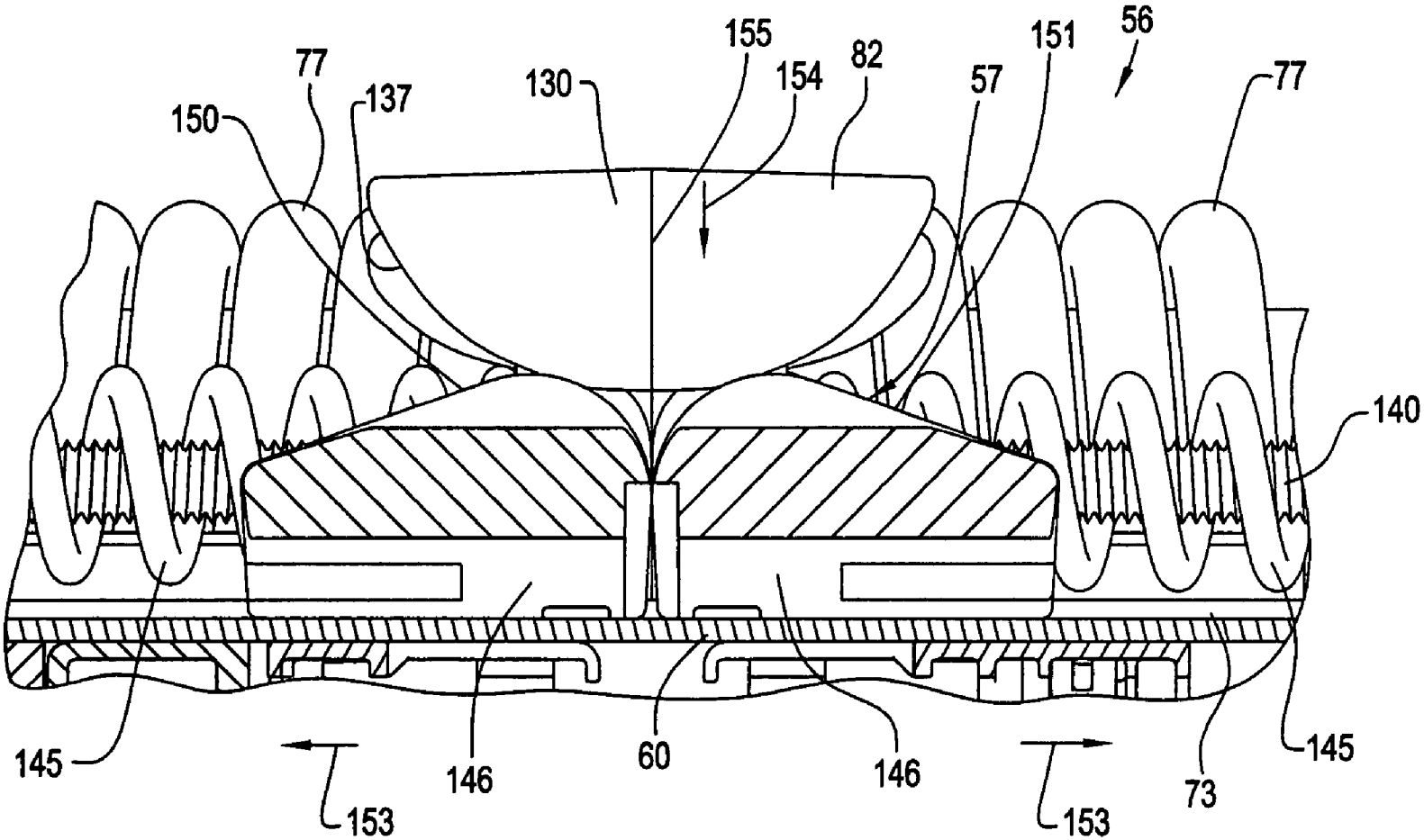
FIG. 22 is an enlarged rear cross sectional view of the tension adjustment mechanism.

Next, the components of this assembly 56 are illustrated in further detail in FIGS. 21 and 22. In particular, the hex shaft 53 is provided wherein the opposite ends 55 thereof are adapted to project outwardly of the control body 19. To support the hex shaft 53 in this control body, the bushing assemblies 67 comprise a pair of outer bushings 112 are provided which snap fit into the respective openings 66 in the body side walls 59. A further rotatable inner bushing 113 is provided in each outer bushing 112 wherein the rotatable bushings 113 include hexagonal openings 114 through which the hex shaft 53 is received. The hex shaft 53 also includes a central liner 116 that is formed in two parts 117 and 118 and surrounds the hex shaft 53 in the region of the coil springs 77 so as to define a smooth outer surface. To support these springs 77 a pair of cylindrical spring bushings 120 are provided which are adapted to be received within the center spring openings 121 to rotatably support these springs 77 on the outer circumference thereof. Only the rightward spring 77 is illustrated in FIG. 21 with the opposite leftward spring 77 being omitted for clarity.

Figure 11:
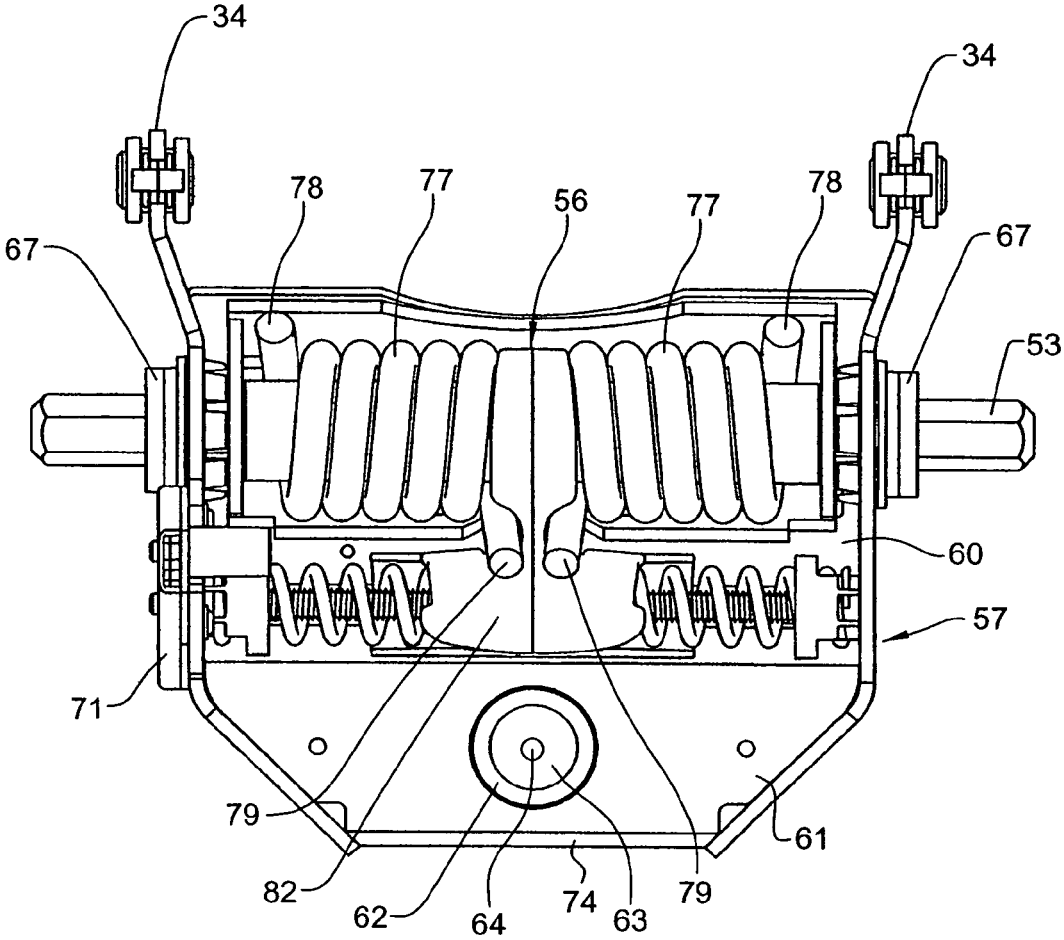
FIG. 11 is a plan view thereof.
Figure 23:
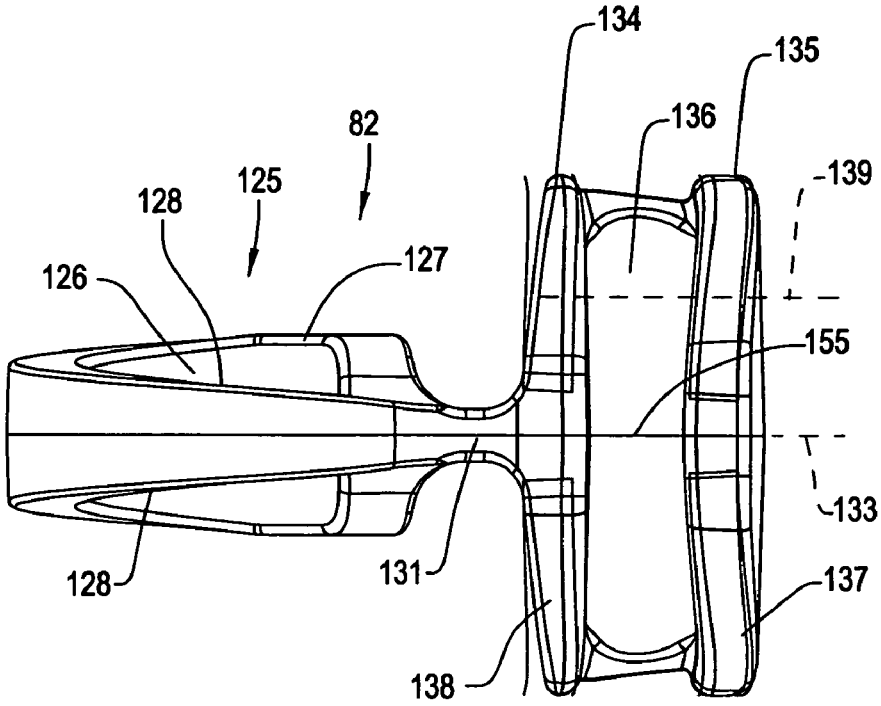
FIG. 23 is a bottom view of a cam wedge.
Figure 24:
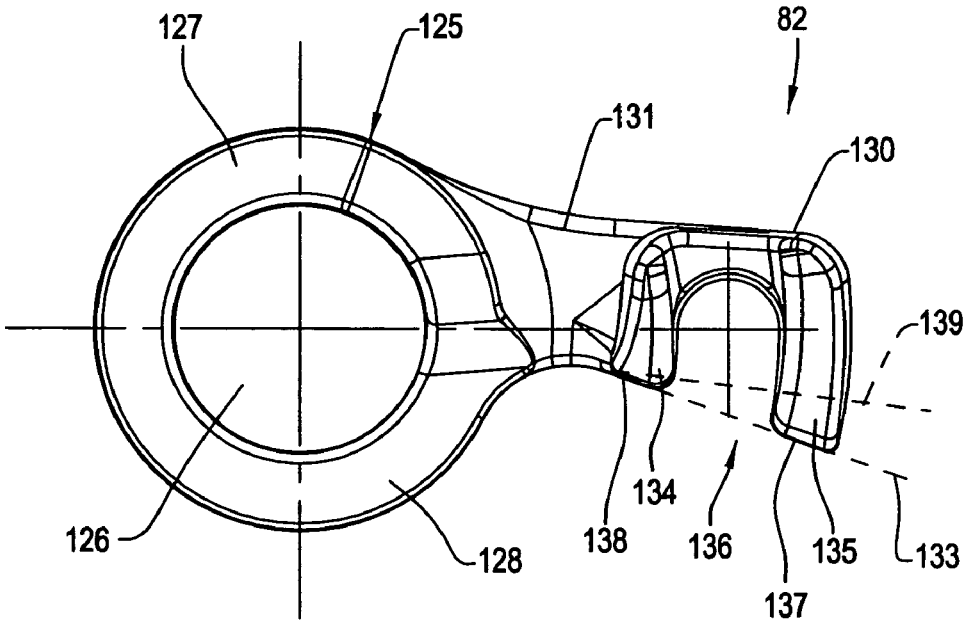
FIG. 24 is a side view of the wedge.
Figure 25:
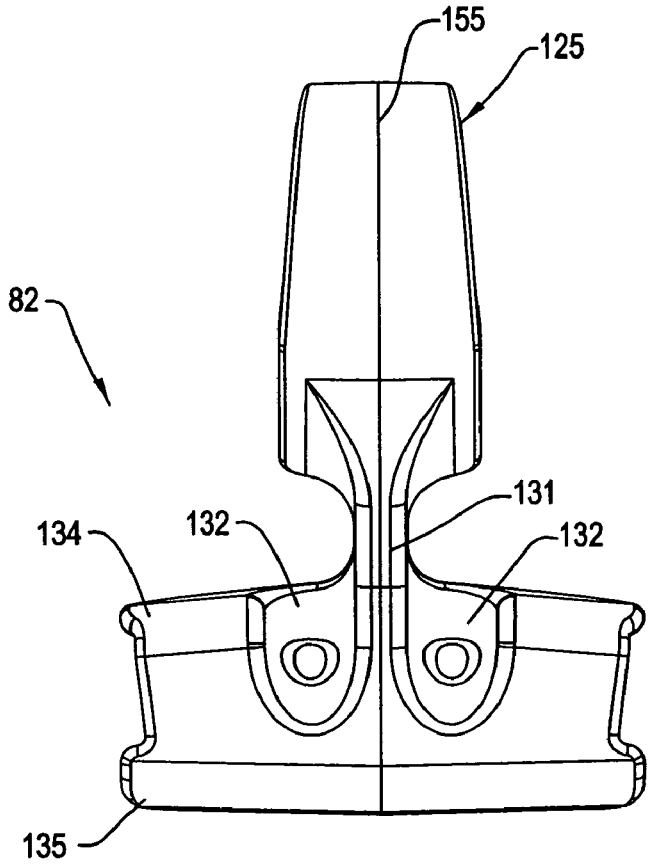
FIG. 25 is a top view of the wedge.

A wedge bushing 123 is also provided to rotatably support the cam wedge 82 thereon between the spring bushings 120 such that all of the springs 77 and wedge 82 are rotatably supported on the outside of the hex shaft 53 as can be seen in FIG. 11. Referring more particularly to the wedge 82 illustrated in FIGS. 22-26, this wedge 82 includes a cylindrical mounting hub 125 which defines a central bore 126 as best seen in FIGS. 23 and 25. This mounting hub is defined by a circumferential hub wall 127 and has an axial thickness defined by axial hub faces 128. The hub faces 128 converge towards each other in the circumferential direction so that the hub wall 127 has a thickness which progressively decreases. This tapered hub wall 127 generally conforms to the coiled shape of the springs 77 as can be seen FIG. 11 and specifically conforms to the angle of the rear spring legs 79.

To cooperate with the adjustment assembly 57, the mounting hub 125 has a wedge section 130 joined thereto by a connector web 131. This connector web 131 is generally narrow as seen in FIG. 23 and is disposed directly adjacent to a pair of arcuate support pockets 132 which are adapted to support the rear spring legs 79 thereon as seen in FIG. 11. As such, the front spring legs 78 (FIG. 11) press inwardly on the inside face of the limit bracket 81 while the rear spring legs 79 press downwardly onto the support pockets 132 of the wedge 82. It is noted that circumferential displacement of the cam wedge 82 varies the relative deflection between these front and rear spring legs 78 and 79. Since the limit bracket 81 pivots in unison with the shaft 53, any adjustment relative to the tension of the coil springs 77 causes the front spring leg 78 to generate an increased or decreased spring load that resists rotation of the hex shaft 53 and thereby resists rearward tilting of the uprights 20.

To vary this spring load or tilt tension on the shaft 53, the wedge section 130 cooperates with and is moved vertically by the adjustment assembly 57 illustrated in FIG. 22.

This wedge section 130 generally has a semi-circular shape when viewed from the end although this wedge section 130 in fact has a three dimensional contour to provide optimum contact between this wedge section 130 and the adjustment assembly 57.

Figure 26:
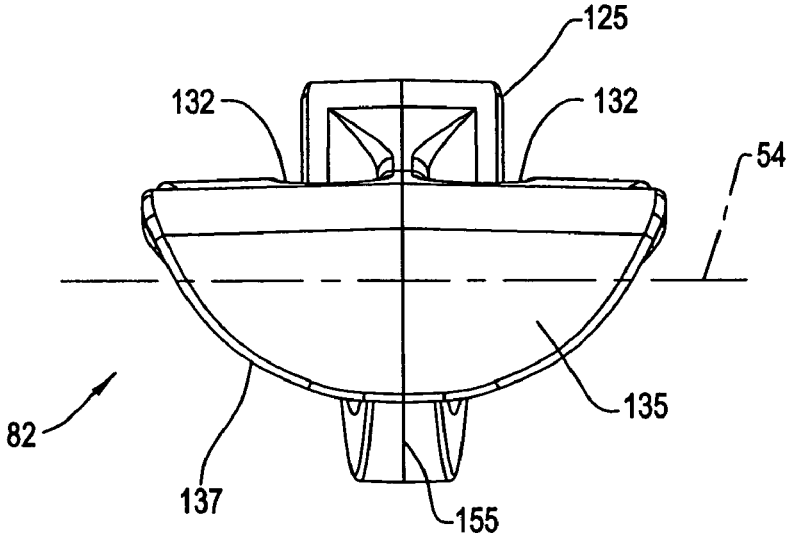
FIG. 26 is a rear view of the wedge.

As to the specific shape of the wedge section 130, this wedge section 130 is defined by a pair of inner and outer wedge walls 134 and 135 which extend generally parallel to each other and define a clearance channel 136 therebetween. As seen in FIGS. 24 and 26, the outer wedge wall 135 has a semi-circular shape (FIG. 26) and also has its bottom edge 137 sloped in the front to back direction as indicated in FIG. 24 by reference arrow 133.

The shorter interior wedge wall 34 also has the same general arcuate shape as the outer wall 135 except that it has a shorter vertical height. As seen in FIG. 24, this interior wedge wall 134 also has its bottom edge 138 sloped in the front to back direction along slope line 133.

It is noted, however, that the bottom wall edges 137 and 138 have a slope which varies along the sideward length thereof. Hence, at a location spaced sidewardly of the wedge centerline 155, the edges 137 and 138 have a shallower slope 139 (FIGS. 23 and 24).

As briefly referenced above, the adjustment assembly 57 acts on this cam wedge 82 to effect rotation thereof and thereby displace the rear spring legs 79 vertically.

Figure 27:
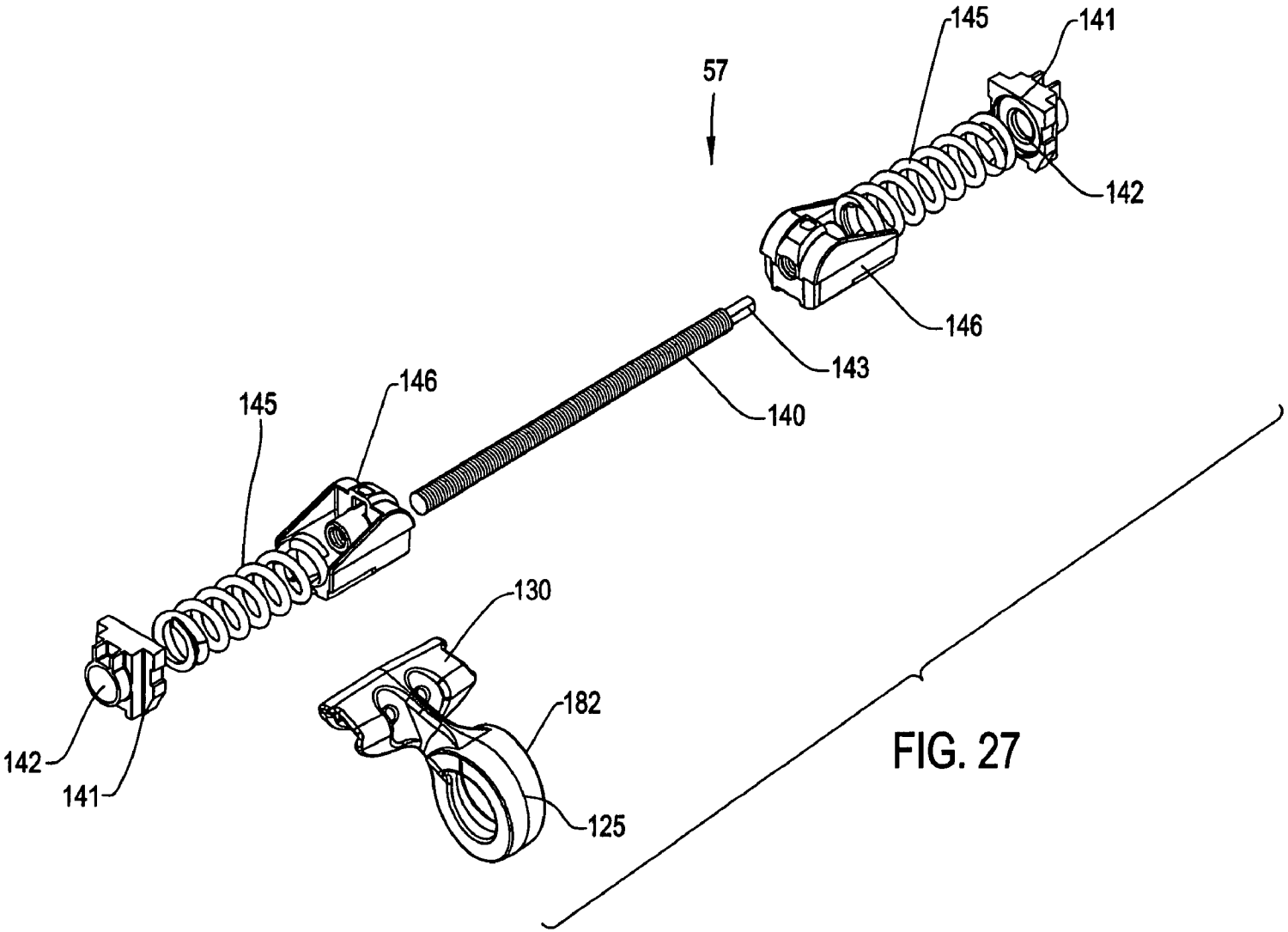
FIG. 27 is an exploded view of the cam drive assembly.

Referring to FIGS. 22 and 27, the adjustment assembly comprises the threaded drive shaft 140 which has its opposite ends supported in the openings 69 of the control body 19 by a pair of bearing blocks 141. These bearing blocks 141 define shaft bores 142 horizontally therethrough which rotatably support the opposite ends of the drive shaft 140. One end of the drive shaft 140 includes a square connector lug 143 which is adapted to engage the gear box 71 as will be described in further detail hereinafter. A pair of springs 145 are slid onto the drive shaft while a pair of drive blocks 146 are threadingly engaged with this drive shaft 140.

Figure 28:
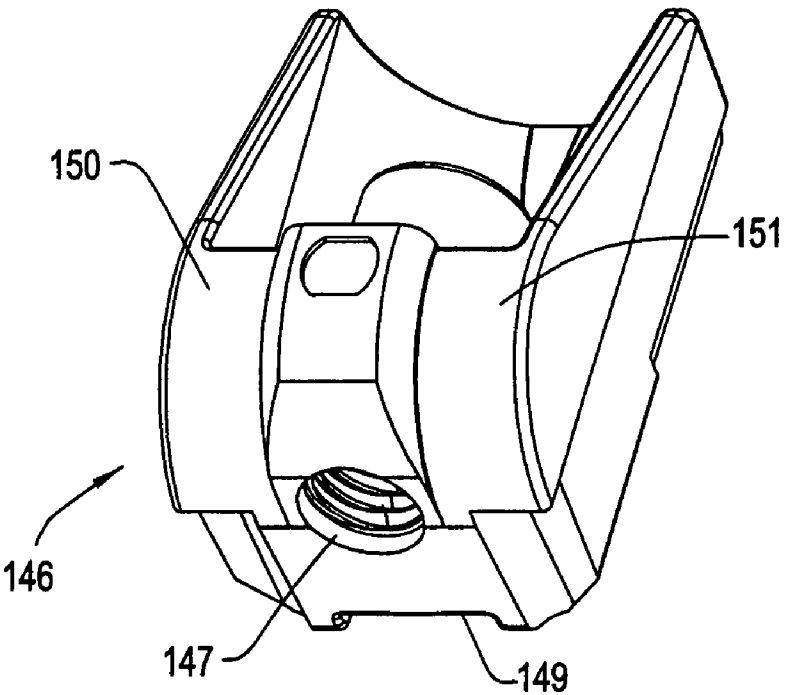
FIG. 28 is an isometric view of one of the drive blocks for the wedge.
Figure 29:
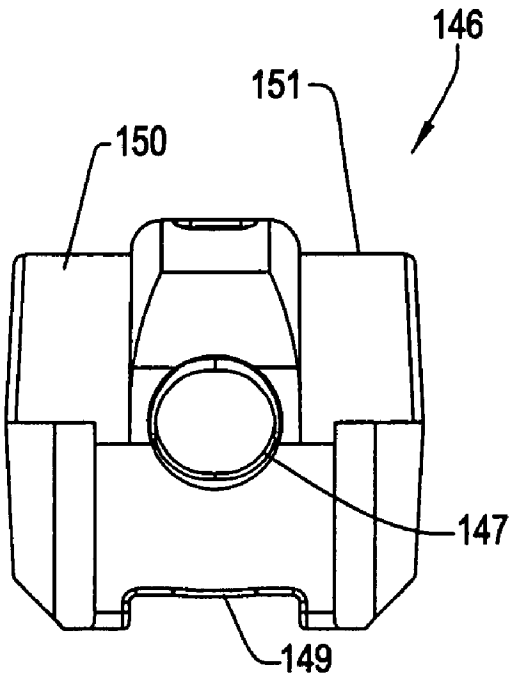
FIG. 29 is an end view of the drive block.
Figure 30:
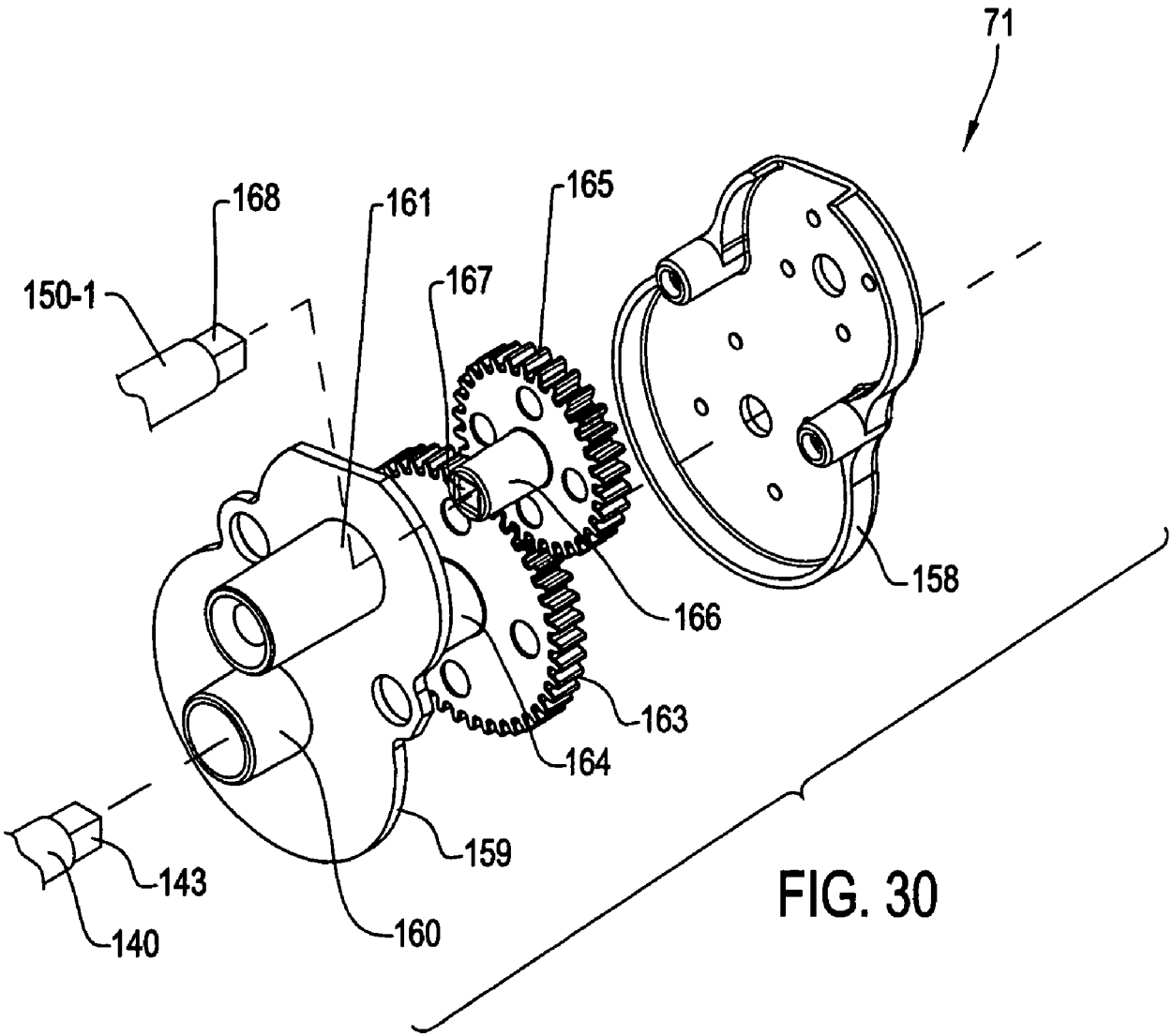
FIG. 30 is an exploded isometric view of a gear box for driving the drive assembly.

Referring to FIGS. 28 and 29, each drive block 146 comprises a threaded bore 147 which engages the drive shaft 140 such that shaft rotation 140 either drives the blocks 146 simultaneously together in one direction, or upon reverse shaft rotation, drive the blocks 146 away from each other toward the side walls 59. The drive blocks 146 each include a guide channel 149 on the bottom thereof which fits onto the guide rail 73 (FIG. 22) and ensures linear sliding of the blocks 146 along this guide channel 73.

The upper surface of each guide block includes a pair of arcuate cam surfaces 150 and 151 which are adapted to support the opposing bottom edges 137 and 138 of the wedge walls 134 and 135. As seen in FIG. 22, these cam surfaces 150 and 151 are flat in the front-to-back direction but have a variable curvature which is relatively steep in the sideward direction. These cam surfaces 150 and 151 are in direct contact with the bottom wall at edges 137 and 138 of the wedge 82. In this regard, the wedge 82 rotates above the hex shaft 53 and as such, the angle that the wedge 82 is in when it is in contact with these drive blocks 146 varies.

For example, in FIG. 22, when the drive blocks 146 are in the abutting position, the wedge 82 is at a first angle relative to the housing bottom wall 60. The taper or contour of the bottom wall edges 137 and 138, however, is designed so that continuous contact is provided along the entire width of these cam surfaces 150 and 151. As these drive blocks 146 are separated from each other in the direction of reference arrows 153 (FIG. 22) the wedge 82 is able to move downwardly in the direction of reference arrow 154 which thereby changes the angle of the wedge 82 relative to the bottom body wall 60. Nevertheless, continuous line contact is still maintained across the width of these cam surfaces 150 and 151 since the taper, for example, taper 139 of the bottom wall edges 137 and 138 varies relative to the taper 133 at the center line 155 of the wedge. Thus, line contact is maintained between the bottom wedge edges 137 and 138 and the opposing cam surfaces 150 and 151 despite relative movement of the drive blocks 146 and wedge 82.

It is noted that the opposing arcuate surfaces of the wedge 82 and the drive blocks 146 are subject to the spring load of the springs 77 which drives the wedge 82 downwardly. As a result of these cooperating arcuate surfaces, this downward spring force in effect tends to push the drive blocks 146 laterally away from each other towards the side walls 59. This normally would generate additional frictional loads between the drive blocks 146 and the threads of the shaft 140. However, the aforementioned springs 145 are provided in compression between the inside faces of the side walls 59 and the opposing side faces of the drive box 136 to generate an axial force on the drive blocks 146 that counteracts the force generated by the coil springs 77. By balancing this axial spring force from the springs 145 against the force of the coil springs 77, the guide blocks 146 are much easier to displace sidewardly during rotation of shaft 140.

Furthermore, the blocks 143 are able to separate in a sufficient distance such that the wedge 82 may straddle the drive shaft 140. In this regard, the wedge groove 136 provides a clearance space in which the shaft 140 is received with the wedge walls 134 and 135 disposed in front of and in back of the shaft 140.

Figure 31:
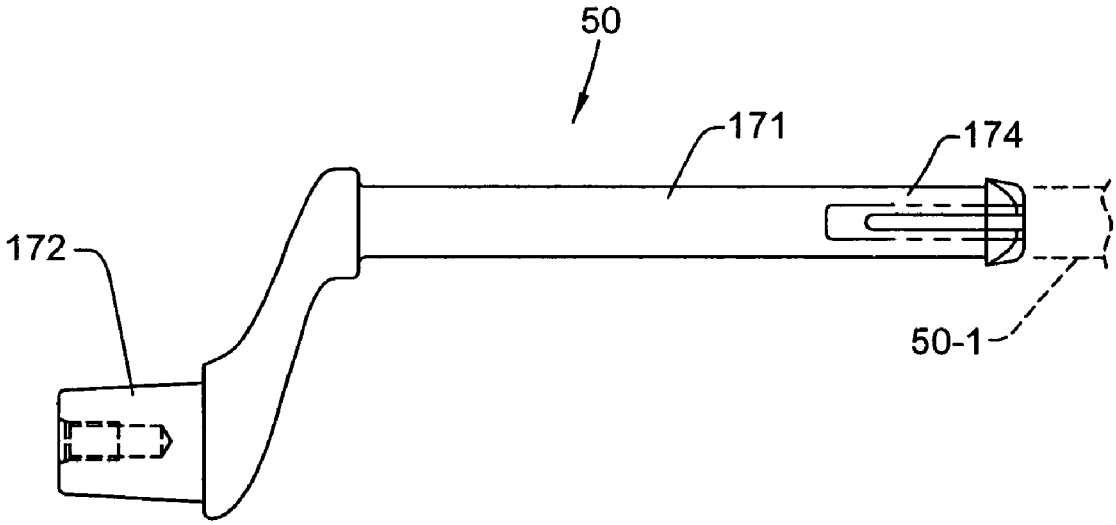
FIG. 31 is a hand crank for driving the drive assembly.

To effect rotation of the drive shaft 140, the gear box 71 is provided. This gear box 71 includes an outer casing 158 and a cover 159. A cover 159 includes a pair of cylindrical support posts 160 and 161. Within the outer case 158, a first idler or driven gear 163 is provided that includes a drive hub 164 which projects through the lower cylindrical support post 160 and seats the lug 143 of the drive shaft 140. Also, an additional pinion or drive gear 165 is provided in meshing engagement with the driven gear 163. This drive gear 165 includes a gear hub 166 which is rotatably supported within the support post 161. This gear hub 166 has a rectangular pocket 167 which is fixedly engaged with a square lug 168 on the drive shaft 50-1. This drive shaft 50-1 is diagrammatically illustrated in FIG. 31 as being connected to a main shaft 171 of the adjustment crank 50 described above and extends into the mechanism 18 through cover opining 38-1 (FIG. 6B). This adjustment crank 50 has a hand piece 172 that may be manually rotated by the chair occupant to thereby rotate the drive shaft 50-1.

The drive shaft 50-1 is relatively rigid but still flexible so that this drive shaft may connect to the engagement section 174 of the shaft 171 which is located directly below the seat assembly 30. This drive shaft 161 then is flexed and bent downwardly into the tilt control mechanism 18 through opening 38-1 so that the opposite end 50-1 can engage the drive gear 165. When the gear box 71 is fully assembled, this drive shaft 50-1 rotates the gear 165 which in turn rotates the driven gear 163 and thereby rotates the threaded shaft 140. In this manner the hand crank 50 controls movement of the drive blocks 146 and varies the tilt tension generated by the springs 77.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A tension adjustment mechanism for controlling tilting resistance of a seat-back assembly in a chair, said tension adjustment mechanism comprising:

a control body;

a pivot member pivotally connected to said control body so as to pivot during tilting of said seat-back assembly;

a biasing member acting on said pivot member to resist pivoting of said pivot member and resist tilting of said seat-back assembly, said biasing member including at least one movable biasing element which is displaceable in opposite first and second directions to vary the tilting resistance generated by said biasing member;

a cam member which supports said biasing element and is movable in said first and second directions to displace said biasing element wherein said cam member includes a cam surface which is tapered in a sideward direction on opposite sides of said cam member; and a drive arrangement having a rotatable adjustment shaft which extends sidewardly within said control body and is manually rotatable, said drive arrangement further including drive members mounted on said adjustment shaft so as to be sidewardly movable toward or away from each other depending upon the direction of rotation of said adjustment shaft, said drive members including cam surfaces which are sidewardly tapered and cooperate with said opposite sides of said tapered cam surface on said cam member wherein movement of said drive members toward each other effects displacement of said cam member in said second direction to counteract said biasing element and movement of said drive members away from each other permits displacement of said cam member in said first direction corresponding to the direction which said biasing element acts on said cam member.

2. A tension adjustment mechanism according to claim 1, wherein said drive members are disposed on said opposite sides of said cam member and mounted in spaced relation on said adjustment shaft.

3. The tension adjustment mechanism according to claim 2, wherein said cam surfaces on said cam member and said drive members are arcuate so as to have a curved taper.

4. The tension adjustment mechanism according to claim 3, wherein at least one of said opposing cam surfaces of said cam member and a respective one of said drive members has an inclined slope in a front to back direction to maintain line contact between and across the front to back width of said opposing cam surfaces.

5. The tension adjustment mechanism according to claim 1, wherein at least one of said cam surfaces of said cam member and a respective one of said drive members has a three dimensional contoured surface which tapers sidewardly and has an inclined slope in the front to back direction to maintain line contact between said opposing cam surfaces across a front to back width thereof during displacement of said cam member.

6. The tension adjustment mechanism according to claim 5, wherein said cam member is pivotally attached to a support shaft so as to pivot about a horizontal axis extending across said control body wherein said cam member is displaced upwardly and downwardly.

7. The tension adjustment mechanism according to claim 1, wherein said biasing member comprises at least one coil spring which said coil spring includes a first spring leg which defines said biasing element.

8. The tension adjustment mechanism according to claim 7, wherein said coil spring includes a second spring leg which is displaced by said pivot member during pivoting thereof wherein the relative positions between the first and second spring legs defines the tilt resistance.

9. A tension adjustment mechanism for controlling resistance to tilting of a seat-back assembly of a chair, said tension adjustment mechanism comprising:

a mechanism body;

a pivot member pivotally attached to said mechanism body which said pivot member pivots about a horizontal pivot axis in response to tilting of said seat-back assembly;

a biasing member acting on said pivot member so as to resist said tilting of said seat back assembly wherein said biasing member includes a biasing element which is displaceable in opposite directions to vary the tilting resistance;

a cam member having a first portion supporting said biasing element wherein said biasing element applies a biasing force against said cam member, said cam member further including a first arcuate cam surface, and being pivotally supported by said mechanism body so as to pivot about a horizontal pivot axis; and a drive arrangement comprising a drive member having second arcuate cam surface disposed in opposing relation with and in sliding contact with said first arcuate cam surface on said cam member, said drive member being displaceable sidewardly in a sideward direction by a manual actuator to effect displacement of said cam member about said pivot axis to vary the relative position of said biasing element and vary the tilt resistance, one of said first and second arcuate cam surfaces having a three-dimensional contour which is tapered in said sideward direction and sloped in a front-to-back direction transverse to said sideward direction to maintain continuous contact across a width of the other of said first and second arcuate cam surfaces during changes in the orientation of said first arcuate cam surface on said cam member during pivoting of said cam member by said drive member.

10. A tension adjustment mechanism according to claim 9, wherein said biasing member is a coil spring having a first spring leg defining said biasing element and a second spring leg which is displaced by said pivot member during pivoting thereof wherein the relative positions of said first and second spring legs vary the tilting resistance.

11. The tension adjustment mechanism according to claim 10, wherein said biasing member comprises at least one coil spring having said first and second spring legs projecting tangentially therefrom.

12. The tension adjustment mechanism according to claim 11, which includes a support shaft on which said coil spring is supported coaxially therewith, said cam member also being pivotally supported by said support shaft which defines said horizontal pivot axis.

13. The tension adjustment mechanism according to claim 9, wherein said one of said first and second arcuate cam surfaces has a slope which varies in the front-to-back direction.

14. The tension adjustment mechanism according to claim 13, wherein said first arcuate cam surface on said cam member is provided with said three-dimensional contour.

15. The tension adjustment mechanism according to claim 14, wherein said cam member has a center portion thereof and side regions sidewardly adjacent said center portion with said slope being steeper in this central region compared to said slope in adjacent said side regions which is shallower.

16. The tension adjustment mechanism according to claim 13, wherein said one of said first and second arcuate cam surfaces has a taper which varies in incline in said sideward direction.

17. The tension adjustment mechanism according to claim 16, wherein said other of said first and second arcuate cam surfaces is tapered in said sideward direction to define a taper which varies in incline in said sideward direction.

18. The tension adjustment mechanism according to claim 9, wherein two said drive members are provided on opposite sides of said cam member and are driven toward each other to displace said cam member transverse to the direction of movement of said drive members.

19. A tension adjustment mechanism for controlling tilting resistance of a seat-back assembly in a chair, said tension adjustment mechanism comprising:

a control body;

a pivot member pivotally connected to said control body so as to pivot during tilting of said seat-back assembly;

a primary biasing member acting on said pivot member to resist pivoting of said pivot member, said biasing member including movable elements which are displaceable to vary the tilting resistance generated by said biasing member;

a cam member which is movable to displace said biasing elements wherein said cam member includes a tapered cam surface and said biasing elements apply an element biasing force to said cam member; and a drive arrangement having a rotatable adjustment shaft which extends sidewardly within said control body and is manually rotatable, said drive arrangement further including drive members mounted on said adjustment shaft so as to be movable toward each other or away from each depending upon the direction of rotation of said adjustment shaft, said drive members including tapered cam surfaces which cooperate with opposite sides of said tapered cam surface on said cam member wherein movement of said drive members toward each other effects displacement of said cam member in a first direction counteracting said biasing elements and movement of said drive members away from each other permits movement of said cam member in a second direction corresponding to the direction which said biasing members act on said cam member, said element biasing force acting on said tapered surfaces of said drive members such that said element biasing force has an axially directed force component;

said drive arrangement further including secondary biasing members acting between said control body and said drive members which each apply a counter-biasing force to said drive members along said shaft axis which said counter-biasing force counteracts the element biasing force applied to said drive members, wherein said counter-biasing force counteracts said axially directed force component to facilitate manual rotation of said adjustment shaft and the resultant movement of said drive members.

20. The tension adjustment mechanism according to claim 19, wherein said control body includes side walls which face sidewardly toward each other and rotatably support said adjustment shaft, said secondary biasing members being disposed in compression between said drive members and said side walls.

21. The tension adjustment mechanism according to claim 20, wherein said secondary biasing members comprise coil springs wherein said coil springs are disposed coaxial with said adjustment shaft which said adjustment shaft extends coaxially through the center of said coil springs.

* * * * *